US008894064B2

(12) United States Patent
Innes

(10) Patent No.: US 8,894,064 B2
(45) Date of Patent: Nov. 25, 2014

(54) INKJET PRINTER ACCESSORY

(75) Inventor: Eric Munro Innes, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1597 days.

(21) Appl. No.: 12/254,866

(22) Filed: Oct. 21, 2008

(65) Prior Publication Data

US 2009/0195628 A1 Aug. 6, 2009

Related U.S. Application Data

(60) Provisional application No. 61/025,280, filed on Jan. 31, 2008, provisional application No. 61/025,283, filed on Jan. 31, 2008.

(51) Int. Cl.

| | |
|---|---|
| ***B65H 5/22*** | (2006.01) |
| ***B65H 83/00*** | (2006.01) |
| ***B65H 85/00*** | (2006.01) |
| ***B65H 29/68*** | (2006.01) |
| ***B65H 43/04*** | (2006.01) |
| ***B41J 2/01*** | (2006.01) |
| ***B41J 13/00*** | (2006.01) |
| ***B41J 11/70*** | (2006.01) |
| ***B41J 13/10*** | (2006.01) |
| ***B26D 1/08*** | (2006.01) |
| *B26D 5/00* | (2006.01) |
| *B26D 5/18* | (2006.01) |
| *B26D 11/00* | (2006.01) |
| *B26D 5/16* | (2006.01) |
| *B26D 5/14* | (2006.01) |

(52) U.S. Cl.

CPC . *B41J 11/70* (2013.01); *B26D 5/00* (2013.01); *B26D 5/18* (2013.01); *B41J 13/009* (2013.01); *B26D 11/00* (2013.01); *B41J 13/106* (2013.01); *B26D 5/16* (2013.01); *B26D 5/14* (2013.01); *B26D 1/085* (2013.01)

USPC ..... 271/198; 271/3.18; 271/6; 271/7; 271/69; 347/104

(58) Field of Classification Search

USPC ..... 270/52.01, 58.01, 58.07; 271/3.14, 271/3.18, 4.01, 6, 7, 278, 69, 198; 347/1, 2, 347/4, 101, 104

See application file for complete search history.

(56) References Cited

U.S. PATENT DOCUMENTS

| | | | | |
|---|---|---|---|---|
| 1,340,137 | A | 5/1920 | Pfister | |
| 2,651,335 | A | 9/1953 | Stagg | |
| 2,673,580 | A | 3/1954 | Pierson | |
| 4,757,732 | A | 7/1988 | Arima | |
| 4,784,318 | A * | 11/1988 | Bay | 234/2 |
| 5,360,161 | A | 11/1994 | Schaller et al. | |
| 5,459,562 | A * | 10/1995 | Mitsuya et al. | 399/364 |
| 6,154,621 | A * | 11/2000 | Yamamoto et al. | 399/68 |
| 6,217,167 | B1 | 4/2001 | Wen et al. | |
| 6,533,169 | B2 | 3/2003 | Robinson et al. | |
| 6,802,663 | B2 * | 10/2004 | Kwasny et al. | 400/621.1 |
| 6,930,802 | B2 | 8/2005 | Sugaya et al. | |
| 6,943,866 | B2 | 9/2005 | Redd et al. | |
| 7,178,458 | B1 | 2/2007 | Bates | |
| 2001/0054342 | A1 * | 12/2001 | Kato et al. | 83/78 |
| 2002/0018680 | A1 * | 2/2002 | Murakami et al. | 399/401 |
| 2002/0034392 | A1 * | 3/2002 | Baum et al. | 396/564 |

(Continued)

*Primary Examiner* — Justin Seo
*Assistant Examiner* — Kendrick Liu

(57) ABSTRACT

An accessory receives sheets from an inkjet printer.

21 Claims, 16 Drawing Sheets

(56) References Cited

U.S. PATENT DOCUMENTS

| | | | | |
|---|---|---|---|---|
| 2002/0067494 | A1* | 6/2002 | Furuya | 358/1.9 |
| 2002/0118990 | A1 | 8/2002 | Kwasny et al. | |
| 2002/0134209 | A1 | 9/2002 | Burman et al. | |
| 2004/0247356 | A1* | 12/2004 | Kaneko et al. | 399/407 |
| 2005/0168775 | A1 | 8/2005 | Liu | |
| 2005/0230895 | A1* | 10/2005 | Kawatsu et al. | 270/52.17 |
| 2006/0171749 | A1* | 8/2006 | Tomita et al. | 399/329 |
| 2006/0176336 | A1* | 8/2006 | Moore et al. | 347/41 |
| 2006/0238811 | A1* | 10/2006 | Soma et al. | 358/1.16 |
| 2007/0125212 | A1 | 6/2007 | Hilgendorf | |
| 2007/0134031 | A1* | 6/2007 | Nogami | 399/322 |
| 2008/0111299 | A1* | 5/2008 | Sato | 271/278 |
| 2008/0122156 | A1* | 5/2008 | Fujii et al. | 270/5.02 |
| 2008/0260446 | A1* | 10/2008 | Harasawa | 399/408 |

* cited by examiner

INKJET PRINTER ACCESSORY

This Application claims the benefit of provisional patent application Ser. No. 61/025,280, filed Jan. 31, 2008, titled "INKJET PRINTER ACCESSORY", which application is incorporated by reference herein as if reproduced in full below.

CROSS-REFERENCE TO RELATED PATENT APPLICATIONS

The present Application is related to co-pending U.S. Provisional Patent Application Ser. No. 61/025,283 filed on Jan. 31, 2008 by Eric Munro Innes and entitled SHEET CUTTER ASSEMBLY, with full disclosure of which is hereby incorporated by reference.

BACKGROUND

Inkjet printers are sometimes used to print upon sheets of media. However, subsequent handling of the printed sheets, such as transporting, cutting and sorting of the printed sheets, may be tedious and time-consuming.

DETAILED DESCRIPTION OF THE EXAMPLE EMBODIMENTS

Figure 1:
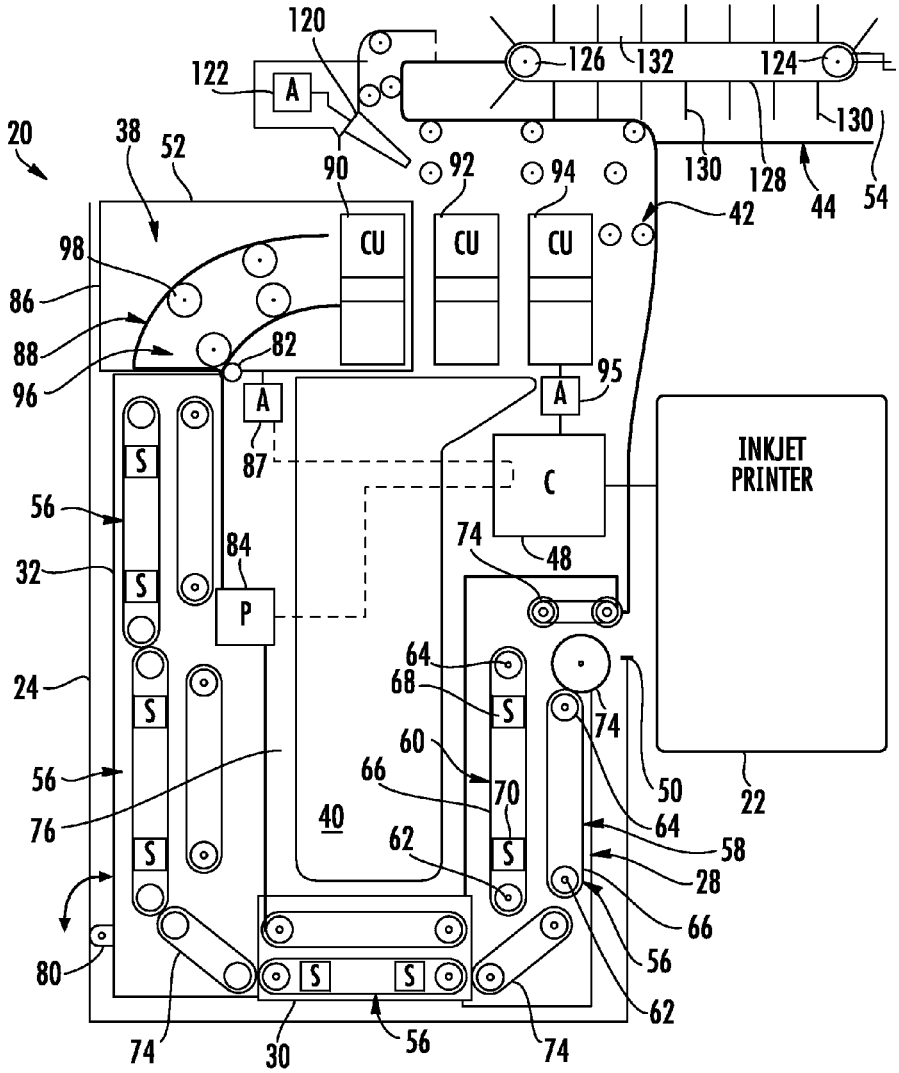
FIG. 1 is a schematic illustration of an inkjet printer and accessory according to an example embodiment.

FIG. 1 schematic illustrates inkjet printer accessory 20 according to an example embodiment. Inkjet printer accessory 20 is configured to receive sheets from the inkjet printer 22 (schematically shown). Accessory 20 is configured to temporarily hold, stage or queue sheets, which may arrive in groups or bursts, from inkjet printer 22 until such sheets may be transported for cutting, sorting and delivery. In particular, accessory 20 is configured to cut or sever leading and trailing edges of sheet as well as side edges or margins of the sheet. Accessory 20 is further configured to sort or partition groups of cut sheets. In the particular embodiment illustrated, accessory 20 is also configured to print a marking, image, or text on a back face of sheets received from inkjet printer 22. Each of these functions is provided in a compact and less complex architecture. In the example illustrated, the architecture is modular, facilitating inspection, repair and replacement of accessory 20.

Accessory 20 includes housing or frame 24, zone one module 28, zone two module 30, zone three module 32, cutter assembly 38, waste receptacle 40, sheet transport 42, sheet sorter 44 and controller 48. Frame 24 comprises a structure configured to support and enclose remaining components of accessory 20. In the example illustrated, frame 24 has an input opening 50 through which sheets from inkjet printer 22 are received. Frame 24 further forms an output tray 52 that receives cut sheets that are not sorted and an overflow tray 54 that receives and stores unretrieved cut and sorted sheets. As will be described in more detail hereafter, frame 24 further facilitates relatively quick insertion and removal of modules 28-32 for inspection, repair or replacement. Although schematically illustrated as being largely rectangular, frame 24 may have other shapes and configurations. Frame 24 may also encompass other devices. In particular embodiments where inkjet printer 22 and accessory 20 are alternatively embodied as a single unit, frame 24 may alternatively encompass both the components of accessory 20 and inkjet printer 22.

Zone one module 28, zone two module 30 and a zone three module 32 serve to transport sheets received from inkjet printer 22 to cutter assembly 38. In addition, modules 28, 30 and 32 further serve to temporally hold, queue or stage sheets and a sequential manner until cutter assembly 38 is ready to accommodate such sheets. As a result, accessory 20 may receive such sheets from inkjet printer 22 which may arise in groups or bursts of output from inkjet printer 22. In other embodiments, modules 28-32 may also be used to stage sheets prior to transmitting such sheets to other media interaction devices such as those that sort, staple, fold or collate sheets.

Each of modules 28-32 is provided as a substantially complete single assembly configured to be removed from and inserted into frame 24 as a single unit. In one embodiment, frame 24 includes projections having tapered ends which are received within corresponding aligned openings in the frame, structure or body of each of modules 28-32. In yet other embodiments, this relationship can be reversed. In one embodiment, frame 24 additionally includes racks, shelves or other guiding structures or bearings which guide movement of the particular module from an access opening into frame 24 and into engagement with the projections. To insert a module, an outer panel of claim 24 is removed, module 28 is grasped and slid along the rack, shelf or other bearing structure until the projections are slid into the opening of the particular module. Initial alignment is facilitated by a smaller end portion of such projections projecting into the opening of the module, wherein the wider base of such projections subsequently engages sides of the opening of the module to provide precise positioning and alignment. Consequently, inspection, repair and replacement of modules 28-32 is facilitated.

As schematically shown in FIG. 1, each of modules 28-32 includes one or more sheet sandwiching transports 56 which move sheets along and through the particular module. Each sheet sandwiching transport 56 comprises a pair of opposing belt assemblies 58, 60. Belt assemblies 58, 60 may have a length greater than the length (the distance between the leading edge and a trailing edge) of the sheet being transported. In particular, each belt assembly includes one or more drive roller 62, one or more idler rollers 64 and one or more endless or continuous belts 66 extending about drive rollers 62 and 64. Drive rollers 62 are rotationally supported by the body of the associated module and are rotationally driven by one or more motors or other rotational actuators (not shown). Drive roller 62 drives belts 66 of assemblies 58, 60 at substantially the same speed. Idler rollers 64 are rotationally supported by the body of the particular module. Drive roller 62 and idler rollers 64 of each assembly 58, 60 have rotational axes that is spaced from one another by distance greater than the length of sheets being transported. Belts 66 comprise straps or bands of material configured to frictionally engage faces of sheets such that the sheets move with the belts.

When transporting a sheet, belts 66 engage opposite faces of the sheet to move the sheet through the particular module. Because the rotational axes of roller 62, 64 are spaced from one another by distance greater than the length of the sheets being transported, the sheets may be transported through or across a greater distance with fewer nips (the pinching area between two opposite rollers). As a result, there is a reduced likelihood of damage to freshly or recently printed images or text upon such sheets just received from inkjet printer 22. In addition, when such sheets are staged, there is a reduced likelihood that such sheets will be pinched in a nip which may damage or deform the sheet. In one embodiment, the rotational axes of roller 62 and 64 are spaced from one another by distance greater than 11 inches. In one embodiment, rollers 62 and 64 have rotational axes spaced from one another by distance of greater than 14 inches. As a result, sheet sandwiching transports 56 may accommodate a large percentage of sheets received from inkjet printer 22 without subjecting such sheets to a large number of nips.

In the example illustrated, each module 28-32 additionally includes a pair of sensors 68, 70. Sensors 68, 70 are configured to detect the presence or absence of a sheet of material between belt assemblies 58, 60. Sensors 68, 70 transmit signals to controller 48 which are used by controller 48 to control the motors (not shown) driving rollers 62. Sensors 68, 70 assist controller 48 in sequentially moving sheets between modules 30-32 and to cutter assembly 38.

In addition, sensors 68, 70 also facilitate the detection of slippage between a sheet being transported and belts 66. For example, sensors 68, 70 are spaced from one another by a predetermined distance. Given a speed at which roller 62 is being driven and absent slippage, a sheet being transported should be detected by sensor 70 a predetermined amount of time after the sheet has been sensed by sensors 68. If such sensing is late, slippage is occurring. In response to such detective slippage, controller 48 may vary the operational parameters (increase or decrease a speed at which roller 62 is driven, move one of belt assemblies 58, 60 towards the other of belt assembly 58, 60 using one or more actuators (not shown) to accommodate such slipping. In addition to slippage detection, sensors 68 and 70 may also be utilized by controller 48 to measure page length.

As shown by FIG. 1, zone one module 28 is positioned proximate to input 50 and includes additional rollers or belts assemblies 74 which cooperate with sheet imaging transport 56 of module 28 to move a sheet in a downward vertical direction from input 52 module 30. Module 30 transports the sheet in a substantially horizontal direction to module 32. Module 32 transports the sheet in a substantially vertical direction to cutter assembly 38. As a result, modules 28-32 form a U-shaped transport path having an interior cavity 76. Cavity 76 provides a space for receiving receptacle 40, permitting accessory 20 more compact.

Module 32 is directly connected to cutter assembly 38. In the example illustrated, module 32 is movably connected to a movable portion of cutter assembly 38. To facilitate such movement, module 32 has a lower portion pivotally connected to frame 24 about a pivot axis 80 and an upper portion pivotably connected to cutter assembly 38 about a pivot axis 82. As a result, a continuous and reliable connection is provided between module 32 and cutter assembly 38 to facilitate reliable transport of sheets therebetween while permitting movement of portions of cutter assembly 38 to accommodate the cutting of differently dimensioned media.

In the particular example illustrated, module 32 to additionally includes print device 84. Print device 84 comprises a device configured to face and print upon a backside or back face (the face of the sheet being transported which is generally not printed upon) the sheet being transported. In one embodiment, the accessory 20 further may retract print device 84 when a two-sided sheet or photo is fed through accessory 20 such that no back side print is performed. Such retraction may be performed by an actuator (electric solenoid, not shown) in response to control signals from controller 48 which may receive signals from the priner 22 identifying such sheets as being printed on both sides.

Print device 84 is configured to print an image, such as a graphics or text. In one embodiment, device 84 maybe configured to print a short description or a date and time. In one embodiment, device 84 comprises a contact printer. In other embodiments, print device 84 may comprise a drop-on-demand inkjet printer. In other embodiments, print device 84 may comprise other print mechanisms. Although print device 84 is shown as being located between a pair of sheet sandwiching transports 58 in module 32, in other embodiments, print device 84 may be located at other locations within module 32 or at other locations in modules 28 or 30.

Cutter assembly 38 comprises an assembly of components configured to cut or sever sheets printed upon by inkjet printer 22. In particular, cutter assembly 38 is configured to cut a leading-edge, a trailing edge and both opposite side edges or margins of the sheet. In some applications, a sheet may contain multiple images serially located between the leading edge and the trailing edge. In such circumstances, cutter assembly 38 is configured to cut the top and bottom margins of each of the serial images on the sheet along with their side edges or margins. As will be described hereafter, cutter assembly 38 is adjustable to facilitate cutting of different widths and different lengths. In addition, in the example illustrated, cutter assembly 38 is configured to concurrently, and potentially simultaneously, cut the leading edge and the trailing edge of a sheet or the top margin in the bottom margin of an image for faster throughput.

Cutter assembly 38 includes cutter carriage 86, actuator 87, sheet transport 88, trailing edge cutter unit 90, leading-edge cutter unit 92, margin cutting assembly 94 and actuator 95. Cutter carriage 86 comprises a structure or framework interconnecting and supporting sheet transport 88 and trailing edge cutter unit 90. Cutter carriage 86 is movably supported relative to frame 24, relative to module 38 and relative to cutter unit 92.

Actuator 87 comprises a device configured to move carriage 86 relative to frame 24 in response to control signals from controller 48. In one embodiment, actuator 87 comprises one or more motors. For example, in one embodiment, actuator 87 comprises a motor, a lead screw and a nut which cooperate to move carriage 86 relative to frame 24. In other embodiments, actuator 87 may have other configurations. Because actuator 87 moves carriage 86 and cutter unit 90 relative to cutter unit 92, cutter assembly 38 may accommodate differently size sheets of media having different lengths or distances between top and bottom margins of images or between leading and trailing edges of the sheet.

Sheet transport 88 comprises a device configured to transport a sheet from module 32 to a position between cutter units 90 and 92. In the example illustrated, sheet transport 88 turns a sheet from a generally vertical orientation to a substantially horizontal orientation. Although sheet transport 88 is illustrated as having a media path 96 and a series of rollers 98 (at least some of which are driven), in other embodiments, sheet transport 88 may alternatively or additionally include belts, conveyors, suction cups or other devices configured to engage and transport a sheet.

Cutter unit 90 comprises a device configured to cut or sever a sheet at a trailing edge of the sheet or along a bottom margin of an image on a sheet. In one embodiment, cutter unit 90 comprises an elongate blade located so as to extend transversely across substantially an entire width of a sheet. In one embodiment, the blade may be moved against an anvil. In another embodiment, the blade may be moved opposite to or in close proximity to an oppositely facing transversely extending blade. In yet another embodiment, cut unit 90 may comprise a rotationally driven circular blade which is transversely moved across the trailing edge of the sheet.

Figure 2:
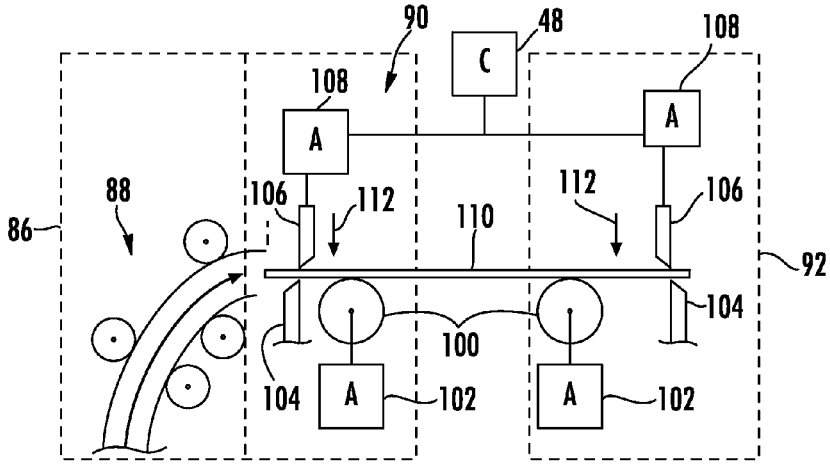
FIG. 2 is a schematic illustration of cutter units of the accessory of FIG. 1 according to an example embodiment.

Cutter unit 92 is substantially identical to cutter unit 90 except that cutter unit 92 is spaced from cutter unit 90 so as to cut or sever a leading edge of a sheet or top margin of an image on the sheet. Unlike cutter unit 90, cutter unit 92 is essentially stationary with respect to frame 24. In other embodiments, cutter unit 92 may also be movable with respect to frame 24 or may have a configuration different than that of cutter unit 90. FIG. 2 schematically illustrates an example embodiment of cutter units 90 and 92. In the example illustrated, cutter units 90 and 92 each include one or more rollers 100, and actuator 102, a stationary knife or blade 104, a movable knife or blade 106 and a blade actuator 108. Rollers 100 comprise rollers located between stationary blades 104 and configured to contact and engage a sheet 110 being cut. Role of the 100 or rotationally driven by actuators 102 based on signals received from controller 48. Actuator 102 drives rollers 100 to appropriately position sheet 110 between cutter units 90 and 92. As noted above, actuator 87 may additionally move and locate cutter unit 90 with respect to cutter unit 92. In other embodiments, rollers 100 and actuators 102 in one or both of units 90, 92 may be omitted or have other configurations.

Stationary blades 104 comprise upwardly facing blades opposite a bottom of sheet 110. Blades 104 are generally stationary during cutting. Movable blades 106 comprise downwardly facing blades offset with respect to blades 104. Actuators 108 comprises mechanisms configured to move blades 106 in the direction indicated by arrows 112 toward stationary blades 104 so as to cut, and a guillotine fashion, sheet 110. In one embodiment, actuator 108 may comprise a motor and a cam arrangement. In another embodiment, actuator 108 may comprise a hydraulic and pneumatic cylinder assembly, electric solenoid or other mechanism configured to reciprocate one or both the blades 106.

In the example embodiment illustrated, controller 48 generates control signals such actuators 108 concurrently or even simultaneously move blades 106 in the direction indicated by arrows 112 towards blades 104 to concurrently or simultaneously cut or sever both the top and bottom margins of sheet 110. Because such cutting is performed concurrently, cutter assembly 38 has enhanced throughput time. The severed trailing and leading end portions of sheet 110 fall under the force of gravity into receptacle 40 shown in FIG. 1. In other embodiments, additional conveyors or other transport means may be used to mover severed trailing and leadings portions of a sheet to receptacle 40. After such cutting, remaining portions of sheet 110 are further transported by rollers 100 to cutter unit 94 shown in FIG. 1.

Cutter unit 94 comprises one or more components configured to cut the side edges or side margins of the sheet, such a sheet 110 shown in FIG. 2. In one embodiment, cutter unit 94 includes a pair of opposite cutter knives or blades located at opposite side edges of the sheet. In one embodiment, such blades are movable together in unison relative to frame 24 and relative to a sheet to be cut. In one embodiment, such blades are additionally movable relative to one another or respect to one another to accommodate different margins. In one embodiment, cutter unit 94 includes a pair of rotating circular blades at each side of the sheet to be cut. In such an embodiment, the sheet is moved against and across the rotating circular blades which rotate about a stationary axis to cut the sheet. In other embodiments, cutter unit 94 may have other configurations.

Receptacle 40 comprises a container configured to receive remnants from sheets that are taught by cutter assembly 38. Receptacle 40 is generally located below cutter assembly 38 such that the remnants fall into receptacle 38. As previously noted, receptacle 40 is contained within void 76 between modules 28, 30 and 32. Receptacle 40 is configured to be removed from accessory 20 for emptying.

Sheet transport 42 comprises an arrangement of guide plates, drive rollers, either rollers, belts and the like configured to transport a cut sheet or distinct portions of a cut sheet from cutter assembly 38 to either tray 52 or sorter 44. In the example illustrated, sheet transport 40 to additionally includes a divertor 120 which pivots between a first position in which such cut sheets are directed to tray 52 and a second position in which shut sheets are directed further along sheet transport 42 to sorter 44. Actuation of the divertor 120 is achieved with a motor or other actuator 122 (schematically shown) operably coupled to divertor 120 and driven in response to control signals from controller 48.

For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members.

Sorter 44 comprises a device configured to receive cut sheets or portions of sheets from sheet transport 42 and to group or partition the sheets for retrieval. In the example illustrated, sorter 44 comprises rollers 124, 126, belt 128 and paddles 130. Rollers 124, 126 comprise one or more rollers supporting belt 128. At least one of rollers 126, 128 is rotationally driven. Belt 128 comprises an endless belt supporting paddles 130. Paddles 130 comprise panels, projections or other structures dimensioned and spaced so as to form intermediate document receiving cavities 132 which receive one or more sheets or portions of sheets to divide and separate different groups of sheets or portions of sheets.

In operation, one of paddles 130 is located at a substantially horizontal or slightly inclined orientation below an output of sheet transport 42. Sheet transport 42 transports and positions one or more sheets of a group onto the paddle 130. After each of the sheets or portions of sheets of a group have been deposited upon the paddle, belt 128 is driven in response to control signals from controller 48 such that paddle 130 rotates to a vertical orientation and the next paddle 130 is in the horizontal or slightly inclined orientation ready to receive sheets of another group. As the paddles 130 are moved from left to right as seen in FIG. 1, groups of sheets, such as groups of photos, may be withdrawn and retrieved by an operator. If such groups of sheets or photos are not retrieved while paddle 130 is in a substantially vertical upwardly extending orientation, the one or more sheets are subsequently dumped or unloaded into overflow tray 54. In other embodiments, sorter 44 may have other configurations or may be omitted.

Controller 48 comprises one or more processing units configured to generate control signals directing the operation of modules 28, 30 and 32, cutter assembly 38, sheet transport 42 and sorter 44. Controller 48 receives signals from sensors 68, 70 as wells from other sensors (not described) of accessory 20 which detect positioning of sheets along cutter assembly 38 and she transport 42 and which also detect various operational parameters are positioning of blades of cutter units 90, 92 and 94, diverter 120 or other components. In the example illustrated, controller 48 further communicates with inkjet printer 22 with regard to sheets to be received from inkjet printer 22. Controller 48 generates control signals to shepherd received sheets through accessory 20 in a sequential fashion and further generate control signals to operably group the finished cut sheets using sorter 44.

For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 92 may be embodied as part of one or more application-specific integrated circuits (ASICs). Unless otherwise specifically noted, the controller is not limited to any specific combination of hardware circuitry and software, nor to any particular source for the instructions executed by the processing unit.

Overall, in operation, inkjet printer 22 prints images or text upon sheets which are discharged into accessory 20 through input 50. Initially, each of modules 28-32 is empty. As a result, the first received sheet is immediately transported to cutter assembly 38. The second received sheet is transported to module 32 where it is staged or held in queue waiting for the first sheet to be cut and transport out of cutter assembly 38. The third received sheet is transported to and staged in module 30. The fourth received sheet is received and staged or held by module 28. Once the first sheet has been cut, each of the third and fourth sheets are transported to the next subsequent modules. At this time, 28 may receive another sheet from printer 22. Alternatively, in applications where inkjet printer 22 ejects printed upon sheets in batches, controller 48 may generate control signals communicating to inkjet printer 22 that accessory 20 is not yet ready to receive a batch of sheets. Once a sufficient number of openings exist for the batch size of printer 22, controller 48 may transmit such signals indicating that accessory 20 is ready to receive the batch.

Although accessory 20 is illustrated as including three modules configured to stage three sheets prior to cutting by cutter assembly 38, in other embodiments, accessory 20 may include a greater or fewer number of such modules and a greater or fewer number of such stages. As noted above, once the sheets are cut, they are transported and delivered to either tray 52 or to sorter 44. Although each of the various described components of accessory 22 is illustrated as being employed together to provide synergistic benefits, in other embodiments, such features may be employed independent of one another. For example, such features as modules 28, 30 and 32, cutter assembly 38 and sorter 44 may be used independent of one another.

Figure 3:
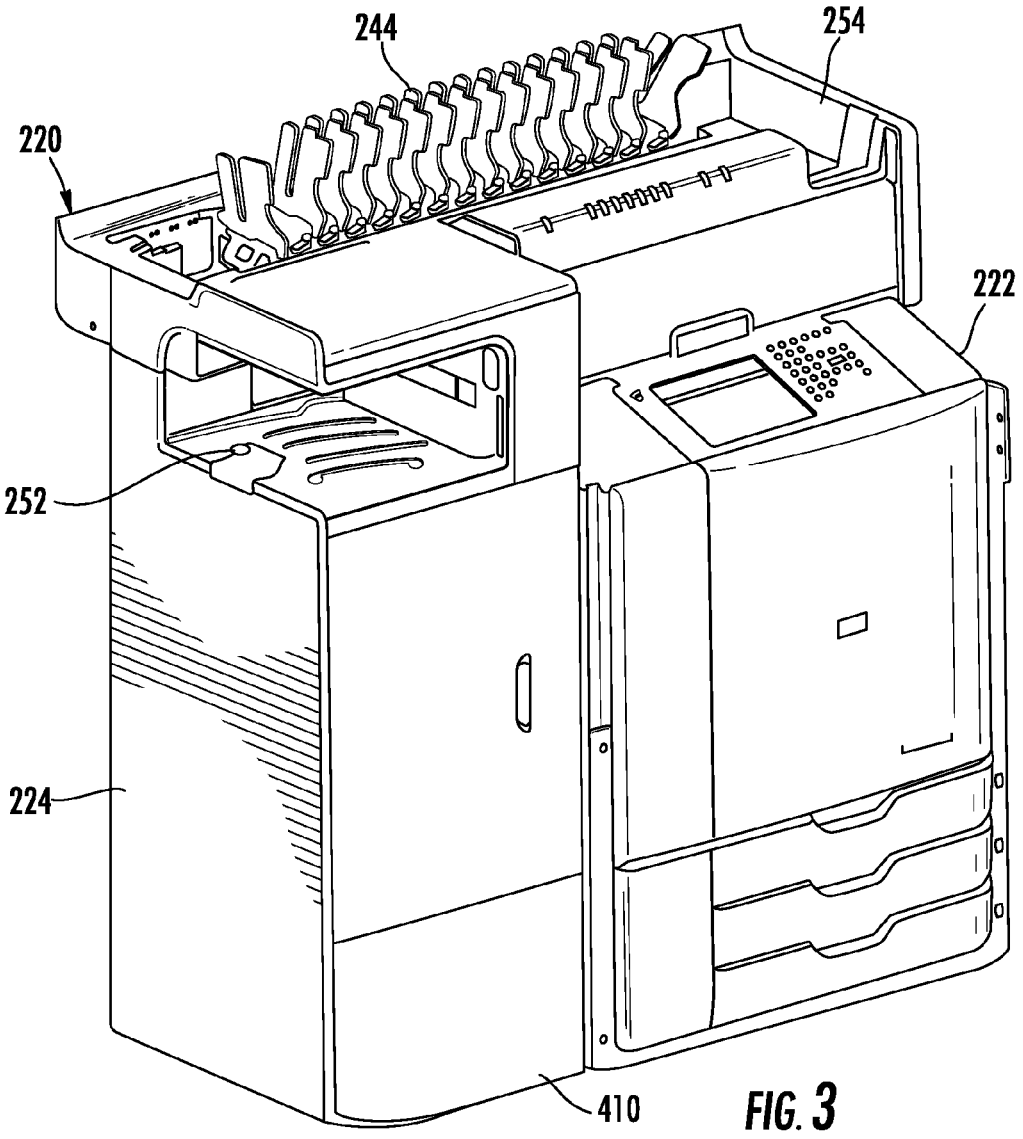
FIG. 3 is a top perspective view of a particular embodiment of the accessory and an inkjet printer according to an example embodiment.

FIGS. 3-17 illustrate accessory 220, a particular example embodiment of accessory 20. FIG. 3 illustrates accessory 220 positioned beside inkjet printer 222 so as to receive printed upon sheets from inkjet printer 222. In the example illustrated, accessory 220 is connected to printer 222 by one or more signal transmitting cables, plugs or ports, facilitating communication between printer 222 and accessory 220. As a result, accessory 220 may be added to inkjet printer 222 to provide additional options for sheets printed upon by printer 222. In the example illustrated, accessory 220 enables inkjet printer 222 to better handle multiple printed upon sheets, wherein each sheet has margins that are to be cut or as multiple images that are to be separated from one another. In the embodiment illustrated, accessory 220 enables inkjet printer 222 to serve as a photo processor or photo lab for processing inkjet printed photos on media paper. In other embodiments, accessory 220 may be used in other applications.

Figure 4:
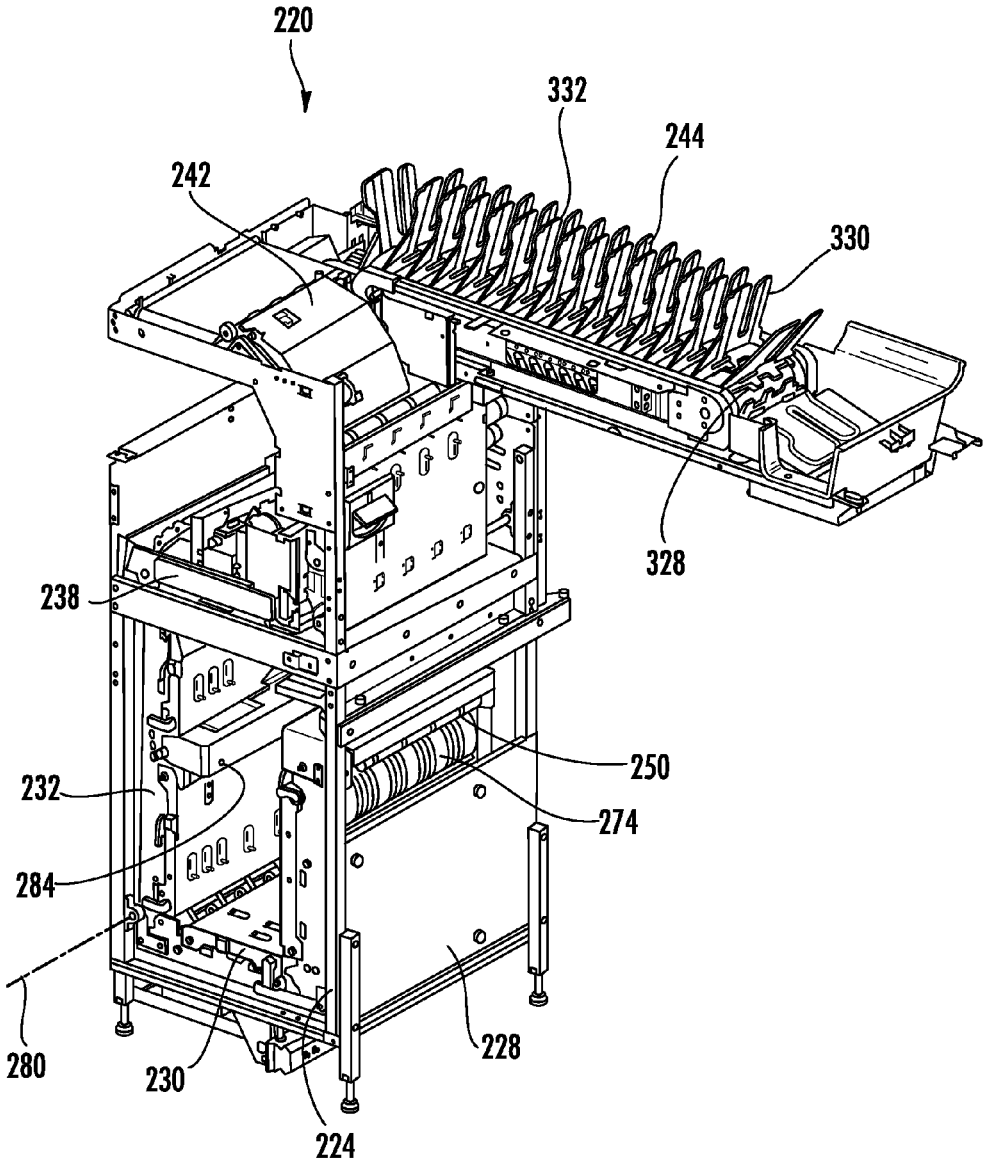
FIG. 4 is a top perspective view of the accessory of FIG. 3 with portions omitted for purposes of illustration according to an example embodiment.

As shown by FIG. 4, accessory 220 includes housing or frame 224, zone one module 228, zone two module 230, zone three module 232, cutter assembly 238, waste receptacle 240 (schematically shown in broken lines in FIG. 5), sheet transport 242, sheet sorter 244 and controller 48 (schematically shown in FIG. 1). Frame 224 comprises a structure configured to support and enclose remaining components of accessory 220. In the example illustrated, frame 224 has an input opening 250 through which sheets from inkjet printer 222 (shown in FIG. 3) are received. Frame 224 further forms an output tray 252 (shown in FIG. 3) that receives cut sheets that are not sorted and an overflow tray 254 (shown in FIG. 3) that receives and stores unretrieved cut and sorted sheets. As will be described in more detail hereafter, frame 224 further facilitates relatively quick insertion and removal of modules 228-232 for inspection, repair or replacement. Although schematically illustrated as being largely rectangular, frame 224 may have other shapes and configurations. Frame 224 may also encompass other devices. In particular embodiments where inkjet printer 222 and accessory 220 are Alternatively embodied as a single unit, frame 224 may alternatively encompass both the components of accessory 220 and inkjet printer 222.

Figure 5:
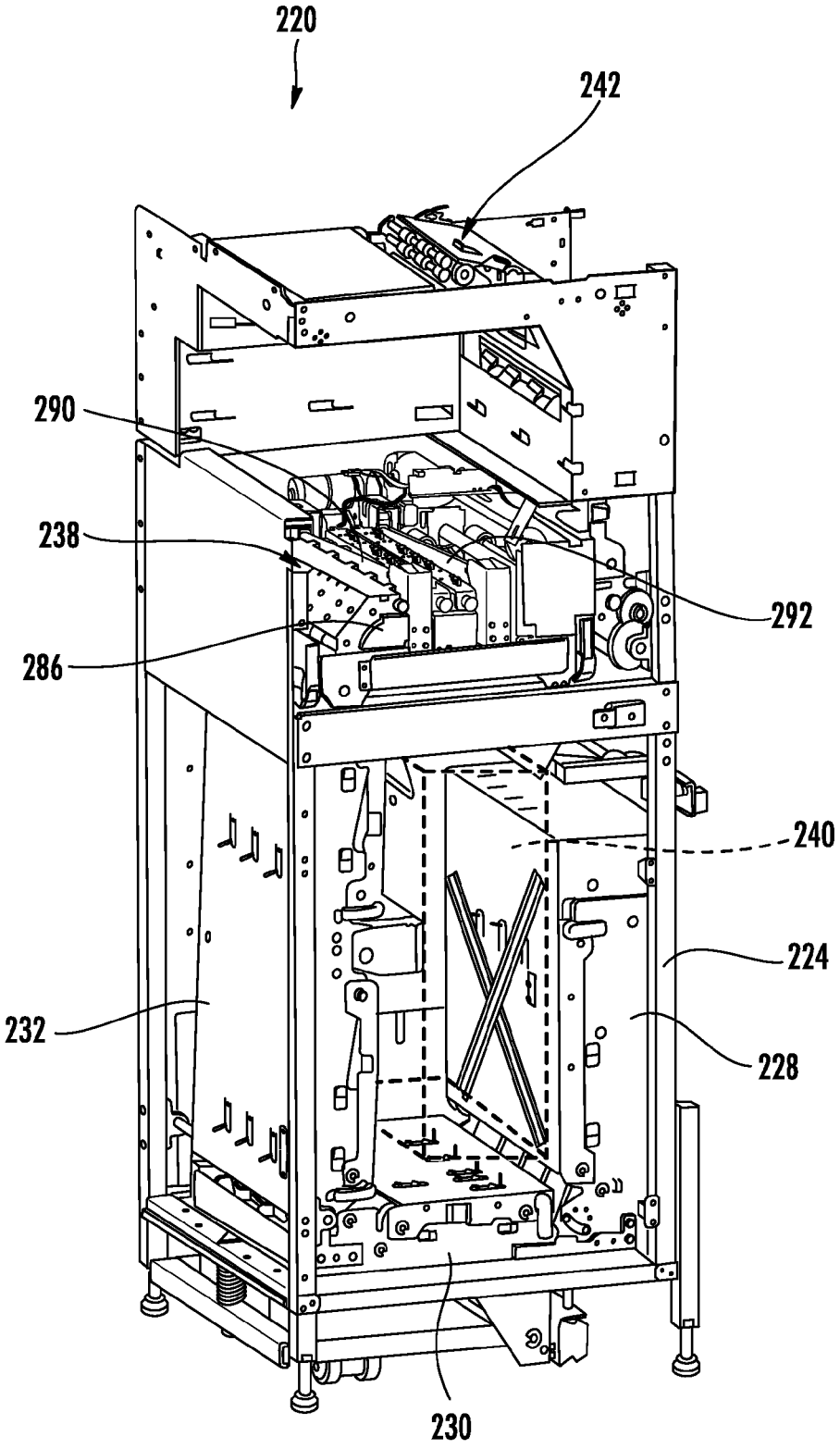
FIG. 5 is another perspective view of the accessory of FIG. 3 with portions omitted for purposes of illustration according to an example embodiment.
Figure 9:
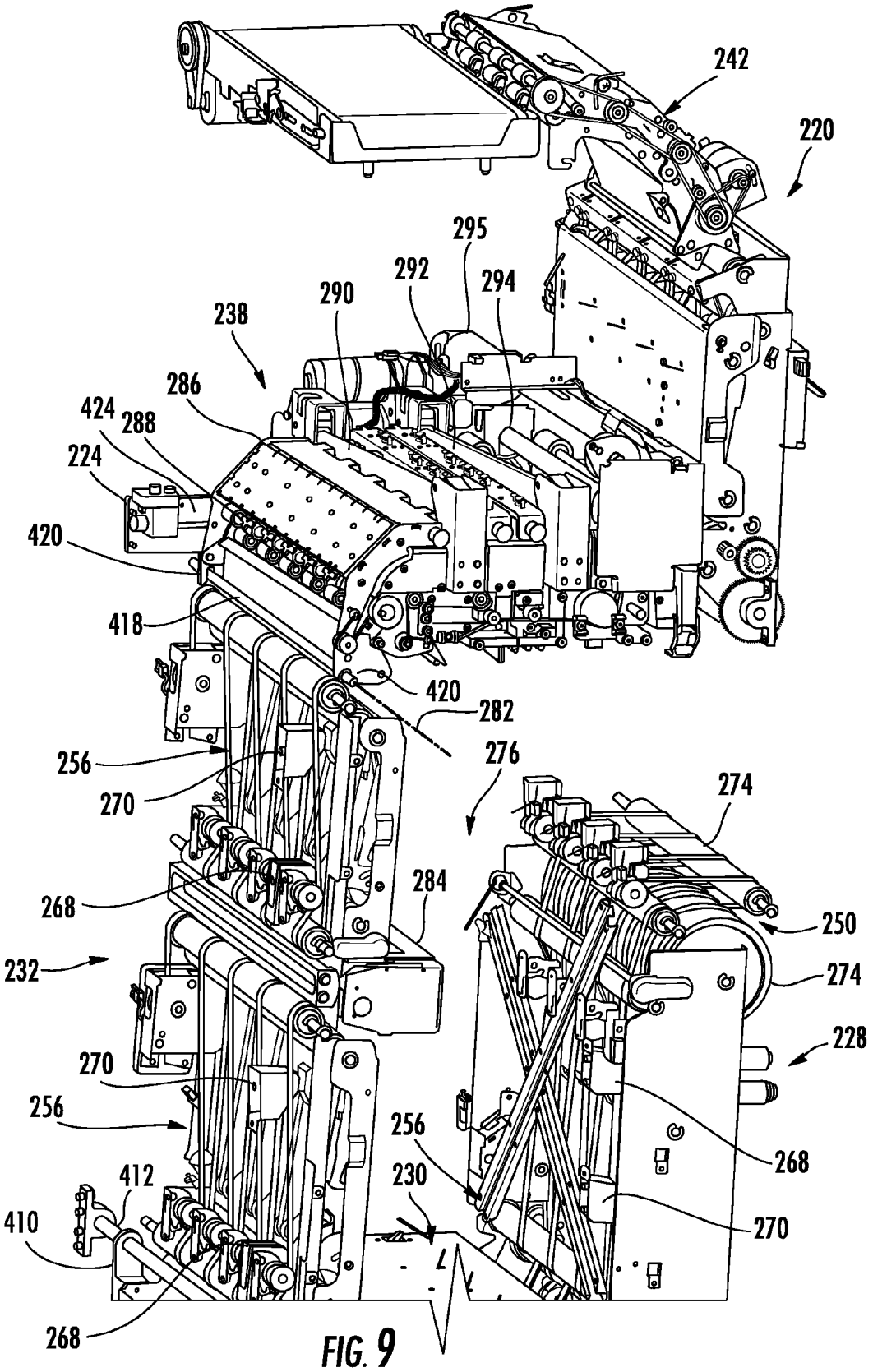
FIG. 9 is a fragmentary perspective view of the accessory of FIG. 5 with portions removed for purposes of illustration according to an example embodiment.

As shown by FIGS. 4, 5 and 9, zone one module 228, zone two module 230 and a zone three module 232 serve to transport sheets received from inkjet printer 222 to cutter assembly 238. In addition, modules 228, 230 and 232 further serve to temporally hold, queue or stage sheets and a sequential manner until cutter assembly 238 is ready to accommodate such sheets. As a result, accessory 220 may receive such sheets from inkjet printer 222 which may arise in groups or bursts of output from inkjet printer 222.

Figure 7:
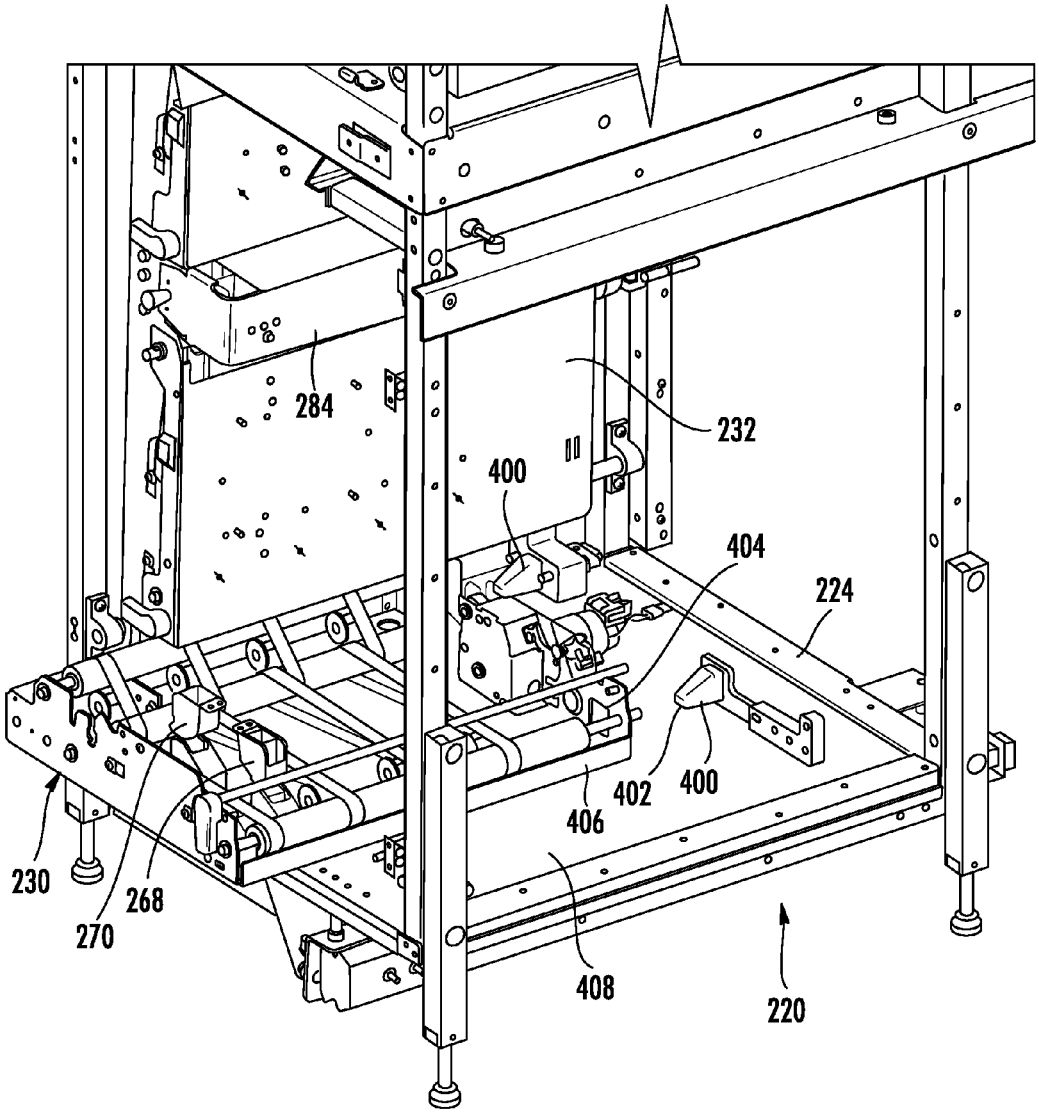
FIG. 7 is a partially exploded perspective view of the module of FIG. 6 separated from the accessory of FIG. 4 according to an example embodiment.

Each of modules 228-232 is provided as a substantially complete single assembly configured to be removed from and inserted into frame 224 as a single unit. FIG. 7 illustrates removable connection of module 230 with respect to frame 224. As shown by FIG. 7, frame 224 includes projections 400 having tapered ends 402 which are received within corresponding aligned openings 404 in the frame, structure or body 406 of module 228. In yet other embodiments, this relationship can be reversed. In addition, frame 224 additionally includes racks, shelves or other guiding structures or bearings 408 which guide movement of module 230 from an access opening into frame 224 and into engagement with the projections 400. To insert module 230, an outer door or panel 410 is removed, module 228 is grasped and slid along the rack, shelf or other bearing structure through 408 until the projections 400 are slid into the opening of module 228. Initial alignment is facilitated by a smaller end portion 402 of such projections projecting into the opening of the module 228, wherein the wider base of such projections 400 subsequently engages sides of the opening 404 of the module 228 to provide precise positioning and alignment. In one embodiment, similar projections 400 and openings 404 or provide for modules 228 and 232. Consequently, inspection, repair and replacement of modules 228-232 are facilitated.

Figure 6:
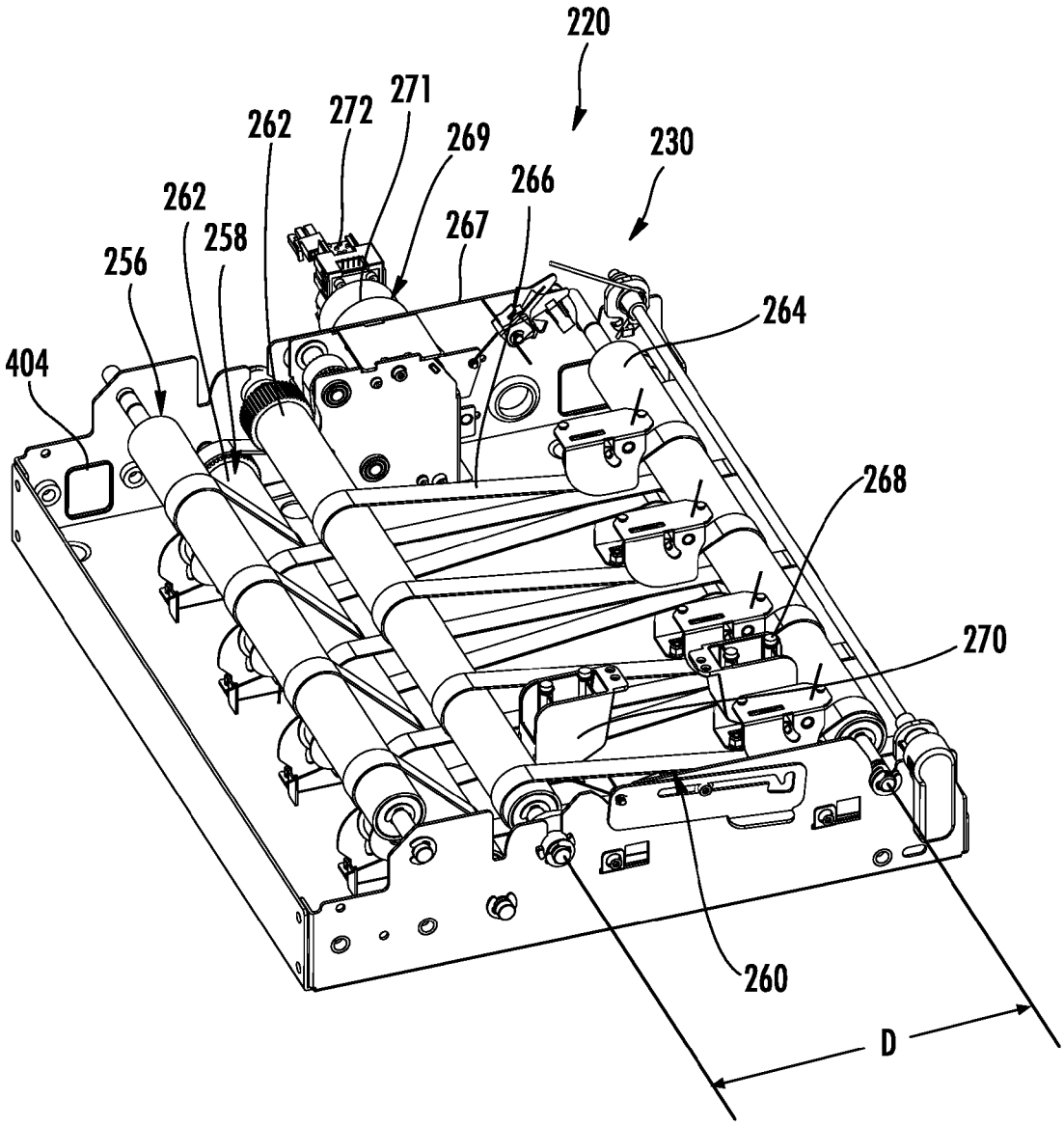
FIG. 6 is a top perspective view of a sheet transport module of the accessory of FIG. 4 according to an example embodiment.
Figure 8:
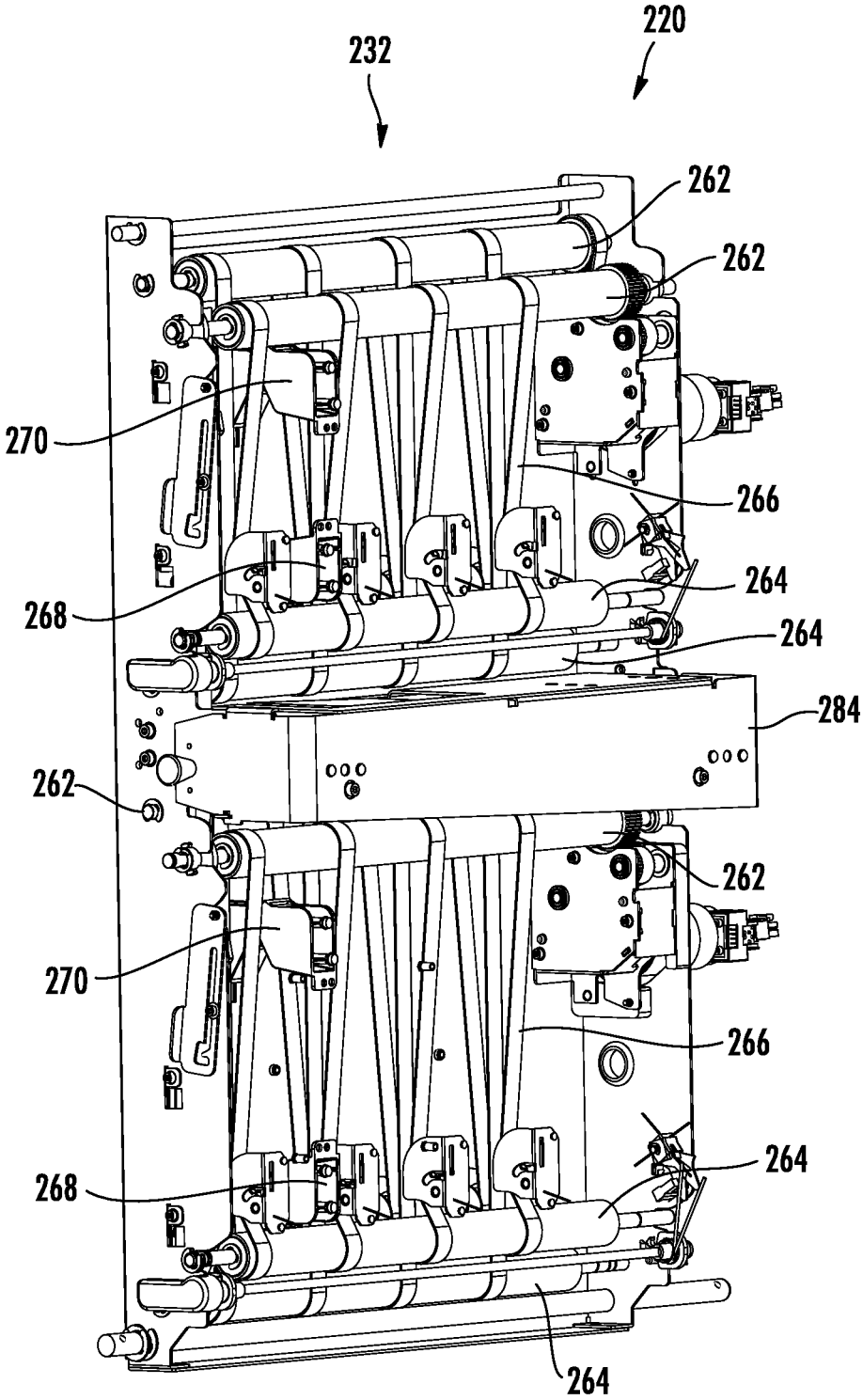
FIG. 8 is a top perspective view of another module of the accessory of FIG. 3 according to an example embodiment.

As shown in FIGS. 6, 8 and 9, each of modules 228-232 includes one or more sheet sandwiching transports 256 which move sheets along and through the particular module. Each sheet sandwiching transport 256 comprises a pair of opposing belt assemblies 258, 260. Belt assembly 258, 260 may have a length greater than the length (the distance between the leading edge and a trailing edge) of the sheet being transported. In particular, each belt assembly includes one or more drive rollers 262, one or more idler rollers 264 and one or more endless or continuous belts 266 extending about drive rollers 262 and 264. Drive rollers 262 or so rotationally supported by the body 267 of the associated module and are rotationally driven by one or more motors or other rotational actuators 269. In the example illustrated, actuator 269 comprises a motor 271 and an associated encoder 272. Drive roller 262 drives belts 266 of assemblies 258, 260 at substantially the same speed. Idler rollers 264 are rotationally supported by the body of the particular module. Drive rollers 262 and idler rollers 264 of each assembly 258, 260 have rotational axes that are spaced from one another by distance D greater than the length of sheets being transported. In other embodiments, the axes of drive roller 262 and idler rollers 264 may be spaced from one another by a distance less than or equal to the length of media sheets being transported. Belts 266 comprises straps or bands a material configured to fractionally engage faces of sheets such that the sheets move with the belts.

When transporting a sheet, belts 266 engage opposite face of the sheet to move the sheet through the particular module. Because the rotational axes of roller 262, 264 are spaced from one another by distance D (shown in FIG. 6) is generally greater than the length of the sheets being transported, the sheets may be transported through or across a greater distance with fewer nips (the pinching area between two opposite rollers). As a result, there is a reduced likelihood of damage to freshly or recently printed images or text upon such sheets just received from inkjet printer 222 (shown in FIG. 3). In addition, when such sheets are staged (stationarily held or moved very slowly), there is a reduced likelihood that such sheets will be pinched in a nip which may damage or deform the sheet. In one embodiment, the rotational axes of roller 262 and 264 are spaced from one another by distance D greater than 11 inches. In one embodiment, rollers 262 and 264 have rotational axes spaced from one another by distance D of greater than 14 inches. As a result, sheet sandwiching transports 258 may accommodate a large percentage of sheets received from inkjet printer 222 (shown in Funeral three) without subjecting such sheets to a large number of nips.

In the example illustrated, each module 228-230 to additionally includes a pair of sensors 268, 270. Sensors 268, 270 are configured to detect the presence or absence of a sheet of material between belt assemblies 258, 260. Sensors 268, 270 transmit signals to controller 48 (schematically shown in FIG. 1) which are used by controller 48 to control the motors 271 driving rollers 262. Sensors 268, 270 assists controller 48 in sequentially moving sheets between modules 230-232 and to cutter assembly 238.

In addition, sensors 268, 270 also facilitate the detection of slippage between a sheet being transported and belts 266. For example, sensors 268, 270 are spaced from one another by a predetermined distance. Given a speed at which roller 262 is being driven and absent slippage, a sheet being transported should be detected by sensor 270 a predetermined amount of time after the sheet has been sensed by sensors 268. If such sensing is late, slippage is occurring. In response to such detective slippage, controller 48 may vary the operational parameters (increase or decrease a speed at which roller 262 is driven, move one of belt assemblies 258, 260 towards the other of belt assembly 258, 260 using one or more actuators left are not shown) to accommodate such slipping.

In the example illustrated, sensors 268 and 270 comprising photo or optical detectors which directly detect the presence or absence of the sheet between either an emitter and a detector or between emitter/detector and a reflector. In other embodiments, sensors 268, 270 may comprise other types of sensors. For example, sensors 268, 270 may alternatively utilize one or more flags which actuate between a photo detector interrupting state and a non-interrupting state.

As shown by FIGS. 4 and 5, zone one module 228 is positioned proximate to input 250 and includes additional rollers or belts assemblies 274 which cooperate with sheet sandwiching transport 56 of module 228 to move a sheet in a downward vertical direction from input 250 to module 230. Module 230 transports the sheet in a substantially horizontal direction to module 232. Module 232 transports the sheet in a substantially vertical direction to cutter assembly 238. As a result, modules 228-232 form a U-shaped transport path having an interior cavity 276. Cavity 276 provides a space for receiving receptacle 240, permitting accessory 220 to be more compact.

Module 232 is directly connected to cutter assembly 238. In the example illustrated, module 232 is directly connected to a movable portion of cutter assembly 238. To facilitate such movement, module 232 has a lower portion 410 pivotally connected to frame 224 about a pivot axis 280 provided by a pivot shaft 412 (shown in FIG. 9) and an upper portion 418 received within a pair of forks 420 to pivotally connect module 232 to cutter assembly 238 about a pivot axis 282. As a result, a continuous and reliable connection is provided between module 232 and cutter assembly 238 to facilitate reliable transport of sheets there between while permitting movement of portions of cutter assembly 238 to accommodate the cutting of differently dimensioned media.

In the particular example illustrated, module 232 additionally includes print device 284. Print device 284 comprises a device configured to face and print upon a backside or back face (the face of the sheet being transported which is generally not printed upon) the sheet being transported. Print device 284 is configured to print an image, such as a photo, graphics or text. In one embodiment, device 284 maybe configured to print a short description or a date and time. In one embodiment, device 284 comprises a contact printer. In other embodiments, print device 284 may comprise a drop-on-demand inkjet printer. In other embodiments, print device 284 may comprise other print mechanisms. Although print device 284 is shown as being located between a pair of sheet sandwiching transports 256 in module 232, in other embodiments, print device 284 may be located at other locations within module 232 or at other locations in modules 228 or 230.

As shown by FIG. 9, cutter assembly 238 comprises an assembly of components configured to cut or sever sheets printed upon by inkjet printer 222 (shown in FIG. 3). In particular, cutter assembly 238 is configured to cut a leading-edge, a trailing edge and both opposite side edges or margins of the sheet. In some applications, a sheet may contain multiple images serially located between the leading edge and the trailing edge. In such circumstances, cutter assembly 238 is configured to cut the top and bottom margins of each of the serial images on the sheet along with their side edges or margins. As will be described hereafter, cutter assembly 238 is adjustable to facilitate cutting of different widths and different lengths. In addition, in the example illustrated, cutter assembly 238 is configured to concurrently, and potentially simultaneously, cut the leading edge and the trailing edge of a sheet or the top margin and the bottom margin of an image for faster throughput.

Figure 10:
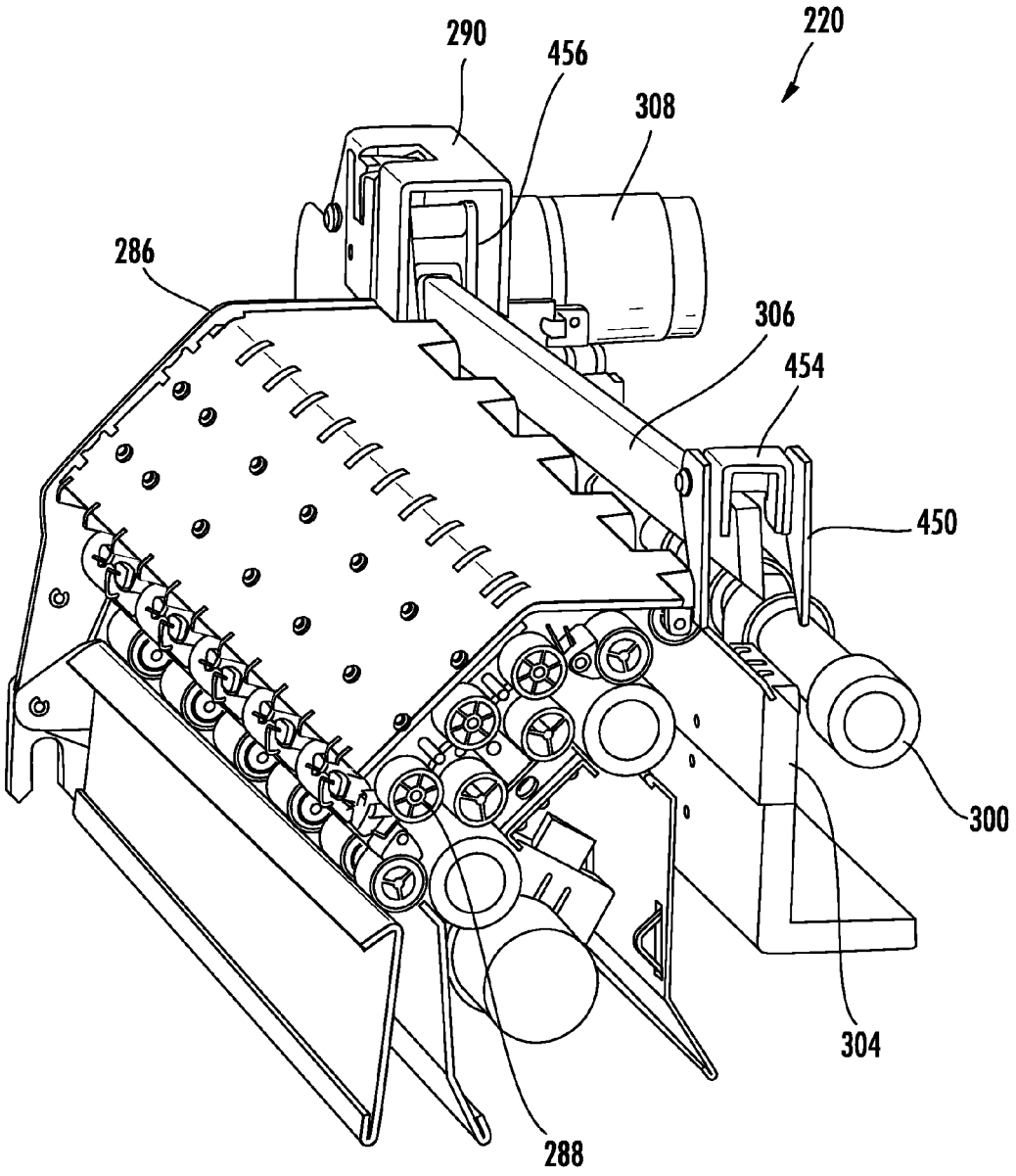
FIG. 10 is a top perspective view of a carriage, sheet transport and cutter unit of a cutter assembly of the accessory of FIG. 4 according to an example embodiment.

Cutter assembly 238 includes cutter carriage 286, actuator 287 (shown in FIGS. 12 and 14), sheet transport 288, trailing edge cutter unit 290, leading-edge cutter unit 292, margin cutting assembly 294 and actuator 295. As shown by FIG. 10, cutter carriage 286 comprises a structure or framework interconnecting and supporting sheet transport 288 and trailing edge cutter unit 290. Cutter carriage 286 is movably supported relative to frame 224 along a guide rod through 424 (shown in FIG. 9), relative to module 232 and relative to cutter unit 292 (shown in FIG. 9).

Figure 11:
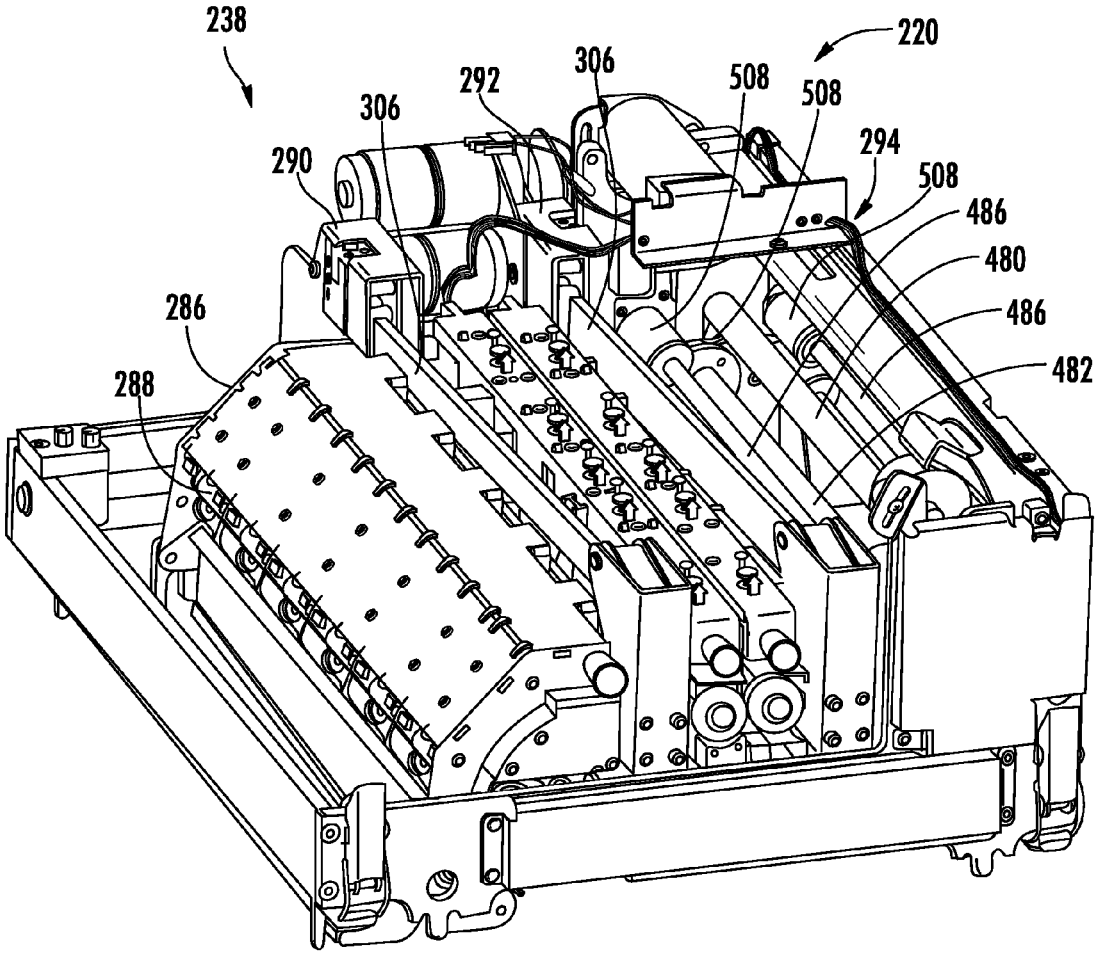
FIG. 11 is a top perspective view of the cutter assembly of FIG. 10 illustrating cutter units in a narrow state according to an example embodiment.
Figure 12:
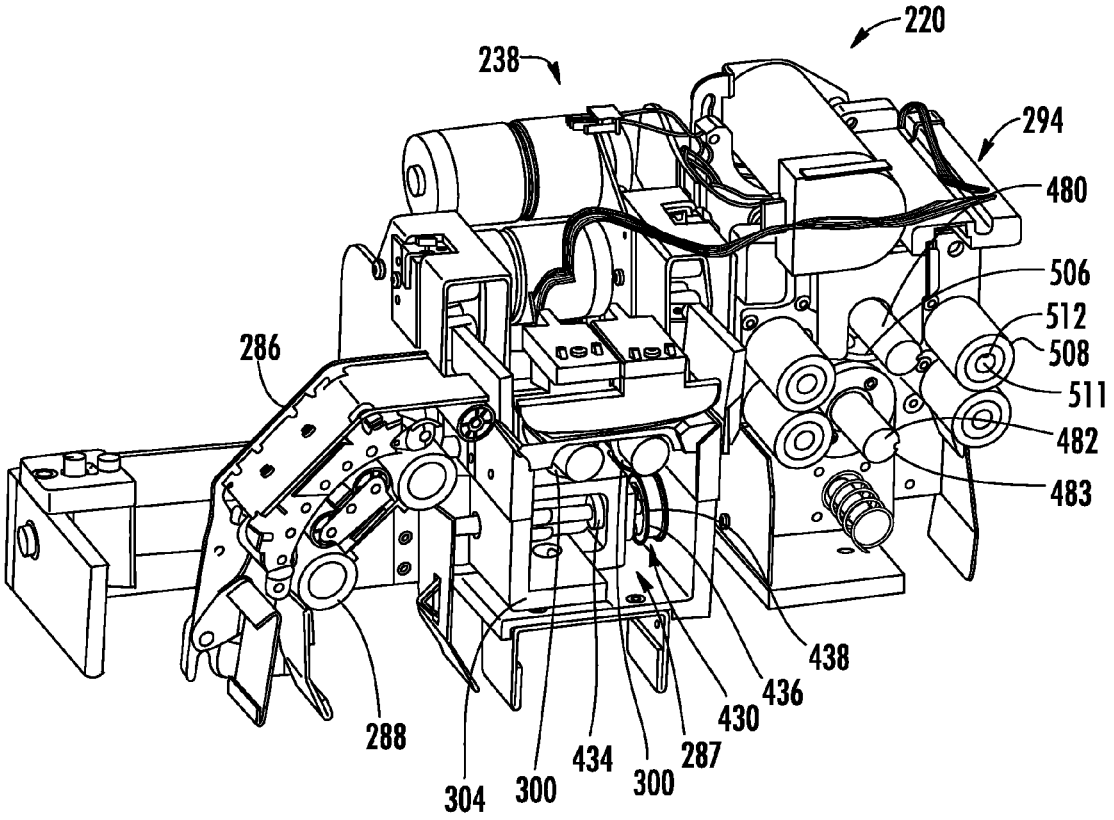
FIG. 12 is a sectional view of the cutter assembly of FIG. 11 according to an example embodiment.
Figure 13:
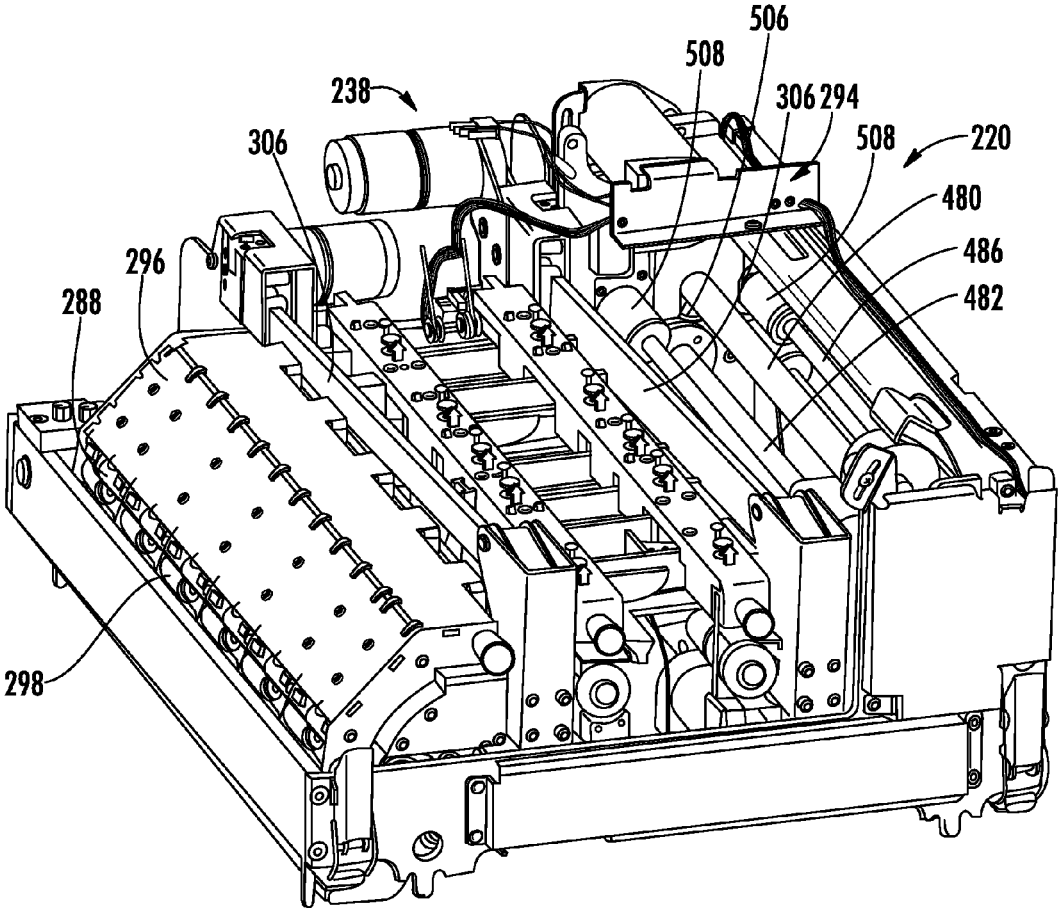
FIG. 13 is a top perspective view of the cutter assembly of FIG. 10 illustrating cutter units in a wide state according to an example embodiment.

FIGS. 11-12 illustrate cutter carriage 286 in a first position in which cutter unit 290 is closest to cutter unit 292. FIG. 13 illustrates cutter carriage 286 in a second position in which cutter unit 290 is farthest away from cutter unit 292. Actuator 287 comprises a device configured to move carriage 286 relative to frame 224 between the first and second positions in response to control signals from controller 48.

Figure 14:
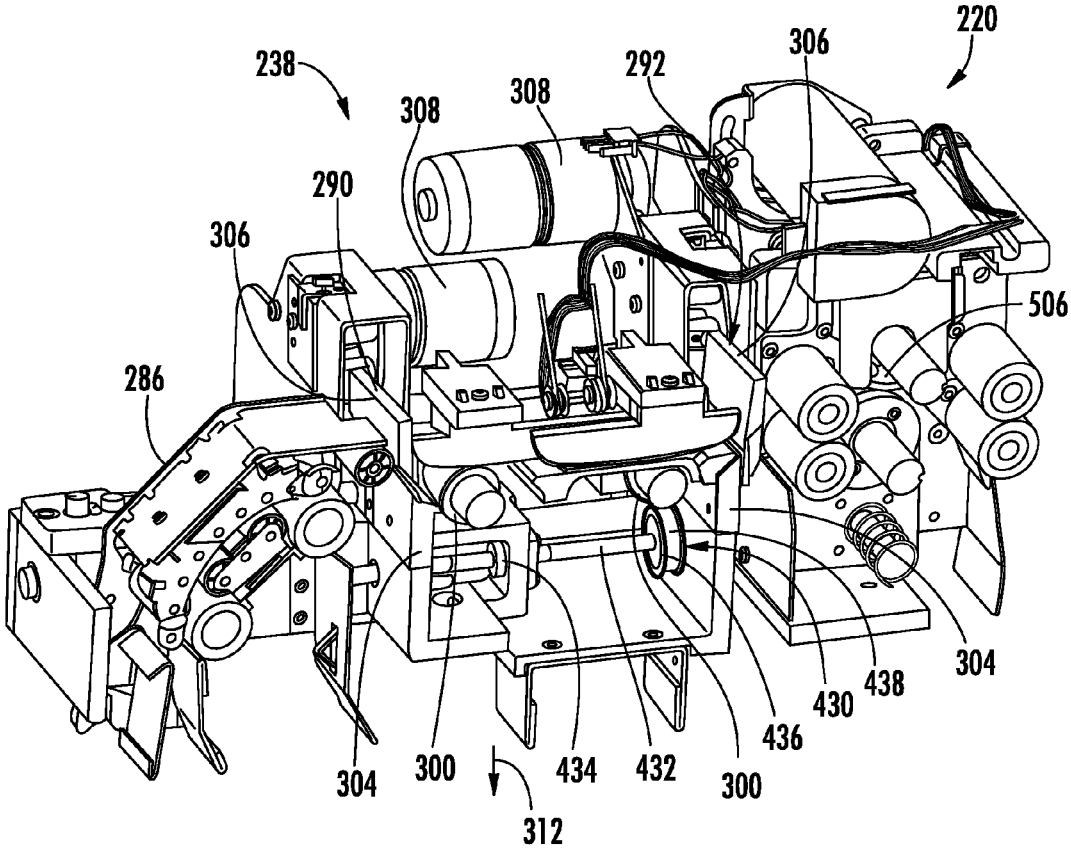
FIG. 14 is a sectional view of the cutter assembly of FIG. 13 according to an example embodiment.

As shown by FIGS. 12 and 14, which are sectional views, actuator 287 includes drive 430, lead screw 432 and nut 434. Drive 430 comprises a mechanism configured to rotationally drive lead screw 432. In the example illustrated, drive 430 includes a pulley 436 secured to lead screw 432 and rotationally driven by a belt 438 which is itself driven by a stepper motor (not shown). In other embodiments, drive 430 they comprise other mechanisms configured to rotationally drive lead screw 432.

Lead screw 432 extends from drive 430 and threadably engages 434. Nut 434 is secured to carriage 286. As a result, rotation of lead screw 432 linearly translates carriage 286 and cutter unit 290 towards and away from cutter units 292. As noted above, during such movement, module 232 pivots about axis 280 (shown in FIG. 4). Because actuator 287 and cutter unit 290 move relative to cutter unit 292, cutter assembly 238 may accommodate differently size sheets of media having different lengths or distances between top and bottom margins of images or between leading and trailing edges of the sheet.

As shown by FIG. 13, sheet transport 288 comprises a device configured to transport a sheet from module 232 to a position between cutter unit 290 and 292. In the example illustrated, sheet transport 288 turns a sheet from a generally vertical orientation to a substantially horizontal orientation. Although sheet transport 288 is illustrated as having a media path 296 and a series of rollers 298 (at least some of which are driven), in other embodiments, sheet transport 288 may alternatively or additionally include belts, conveyors, suction cups or other devices configured to engage and transport a sheet.

FIGS. 11-14 illustrate cutter units 290 and 292. In the example illustrated, cutter units 290 and 292 each include one or more rollers 300, a stationary knife or blade 304, a movable knife or blade 306 and a blade actuator 308. Rollers 300 comprise rollers located between stationary blades 304 and configured to contact and engage a sheet being cut. Rollers 300 are rotationally driven based on signals received from controller 48. Actuators (not shown) drive rollers 300 to appropriately position a sheet between cutter units 290 and 292. As noted above, actuator 287 may additionally move and locate cutter unit 290 with respect to cutter unit 292. In other embodiments, rollers 300 and their actuators in one or both of units 290, 292 may be omitted or have other configurations.

Stationary blades 304 comprise upwardly facing blades opposite a bottom of a sheet being cut. Blades 304 are generally stationary during cutting. Movable blades 306 comprise downwardly facing blades offset with respect to blades 304. Actuators 308 comprise mechanisms configured to move blades 306 in the direction indicated by arrows 312 toward stationary blades 304 so as to cut a sheet in a guillotine fashion.

Figure 15:
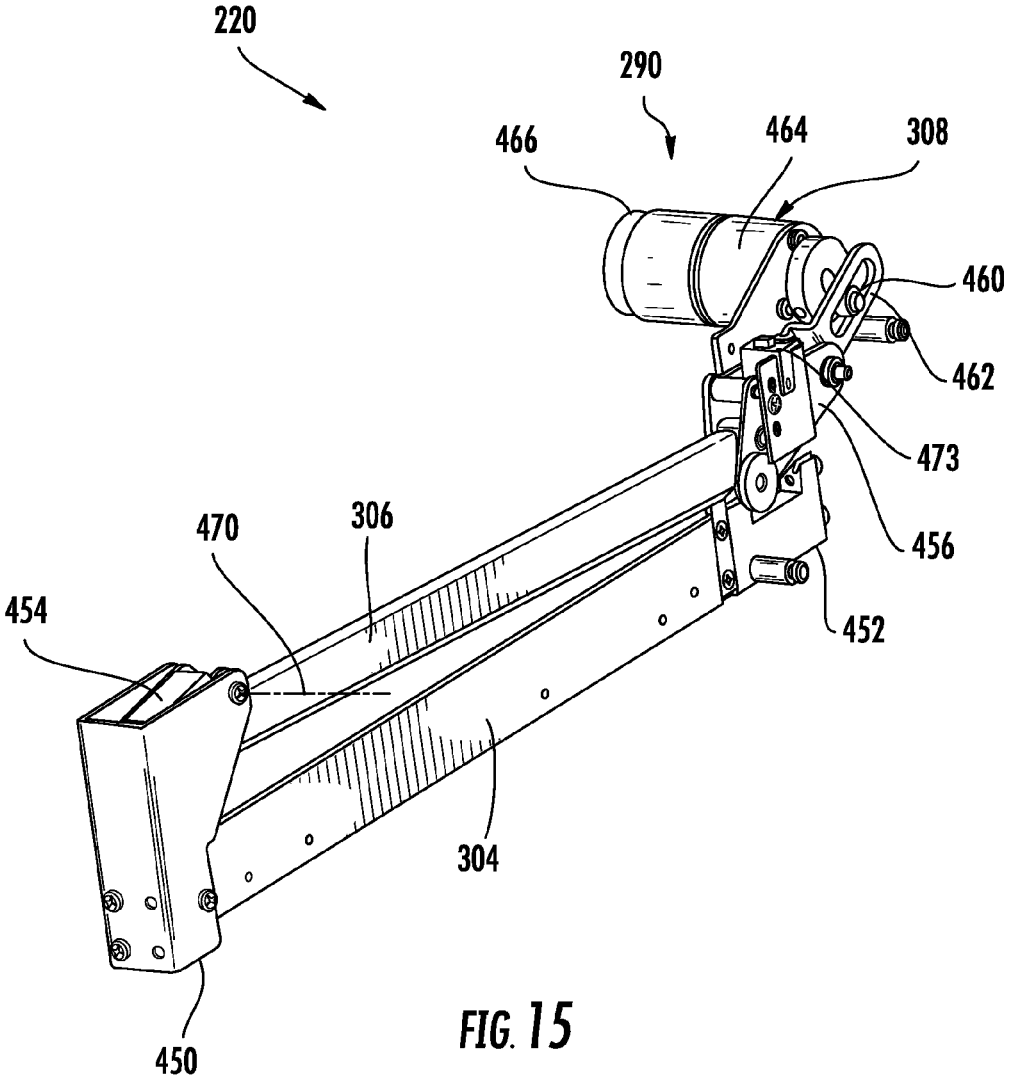
FIG. 15 is a top perspective view of a cutter unit of the cutter assembly of FIG. 11 according to an example embodiment.
Figure 16:
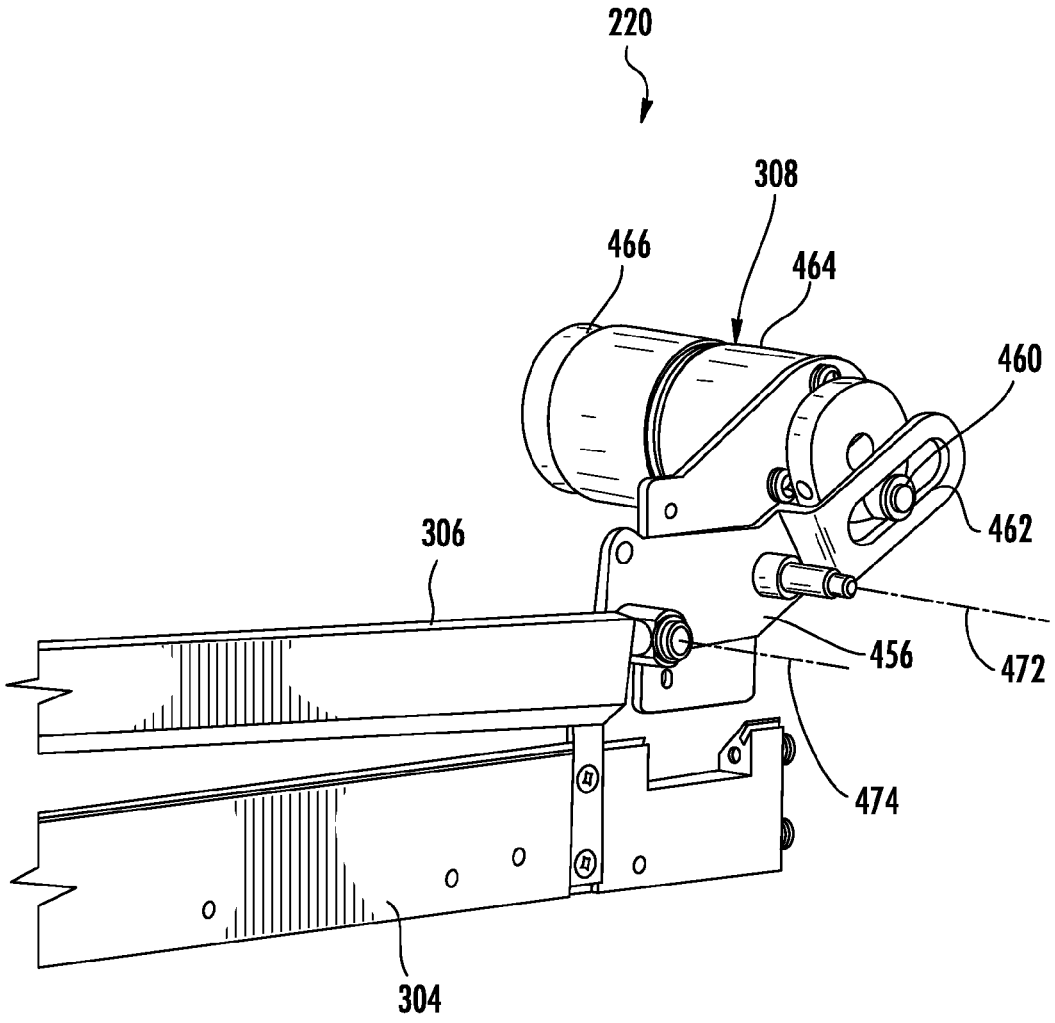
FIG. 16 is an enlarged fragmentary perspective view of the cutter unit of FIG. 15 with portions removed for purposes of illustration according to an example embodiment.

FIGS. 15 and 16 illustrate actuator 308 and portions of cutter unit 290 in detail. As shown by FIG. 15, cutter unit 290 additionally includes end frames 450, 452, swing arm or linkage 454 and swing arm or linkage 456. Actuator 308 includes cam 460, cam follower 462, motor 464 and encoder 466. End frames 450, 452 are supported by carriage 286 (for cutter unit 290) or frame 224 (for cutter unit 292). Frame 450 is secured to an end of blade 304 and pivotally supports linkage 454. Frame 452 is secured to an opposite end of blade 304.

Linkage 454 comprise an arm having a first end evidently connected to frame 450 for pivotal movement about axis 470 and a second and pivotally secured to blade 306. Linkage 456 has a central portion pivotally supported about axis 472. As with cutter unit 290, linkage 456 is pivotably supported by a frame or body of carriage 286. With cutter unit 292, link 456 is pivotally supported by frame 224. In the example illustrated, linkage 456 further serves as a flag which blocks a photo detector 473 at selected times when pivoting, wherein signals from a photo detector 473 are received by controller 48 to enhance tracking of the position of blade 306. In other embodiments, linkages 450 and 452 may be pivotally supported by other structures. As further shown by FIG. 16, linkage 456 is pivotably connected to blade 306 about axis 474. As a result, blades 304, 306 slice rather than chop across the sheet.

Cam 460 and cam follower 462 cooperate to convert rotational motion or torque from motor 464 into motion which reciprocates and pivots link 456 about axis 472. In the example illustrated, cam follower 462 comprises an elongate slot formed in linkage 456. Cam 460 comprises a roller bearing received within the slot and eccentrically connected to an output shaft of motor number 464. Rotation of motor 464 rotates cam 460 which interacts with cam follower 462 to pivot linkage 456 about axis 472 to raise and lower blade 306. The positioning of blade 306 is tracked using encoder 466 which transmit signals to controller 48 (shown in FIG. 1). In other embodiments, actuator 308 may have other configurations. As noted above, cutter unit 292 is substantially similar to cutter unit 290.

In the example embodiment illustrated, controller 48 generates control signals such actuators 308 concurrently or even simultaneously move blades 306 in the direction indicated by arrows 312 towards blades 304 to concurrently or simultaneously cut or sever both the top and bottom margins of a sheet. Because such cutting is performed concurrently, cutter assembly 238 has enhanced throughput time. The severed trailing and leading end portions of sheet 110 fall under the force of gravity into receptacle 40 shown in FIG. 5. After such cutting, remaining portions of a sheet are further transported by rollers 300 to cutter unit 294 shown in FIG. 1.

Figure 17:
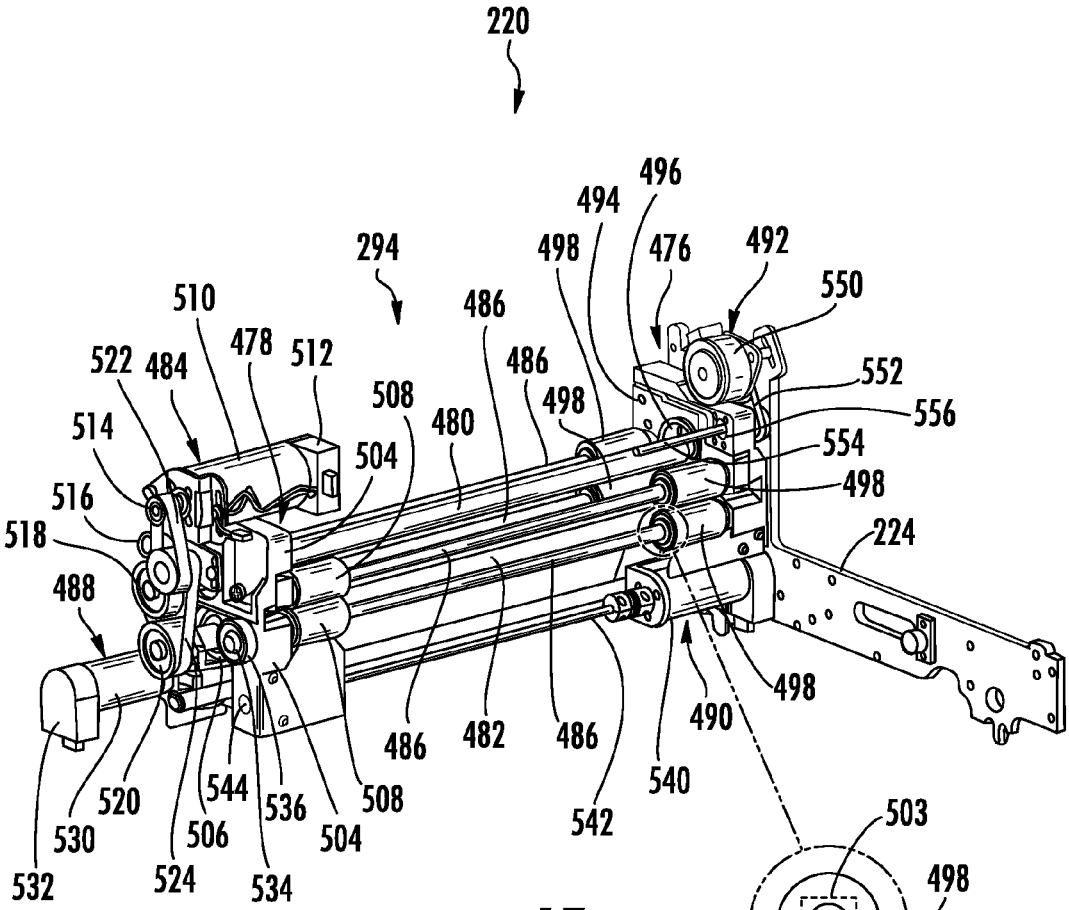
FIG. 17 is a top perspective view of another cutter unit of the cutter assembly of FIG. 11 according to an example embodiment.

FIG. 17 illustrates cutter unit 294 in more detail. Also known as a slitter, cutter unit 294 comprises one or more components configured to cut the side edges or side margins of the sheet. As shown by FIG. 17, cutter unit 294 includes margin carriage assembly 476, width carriage assembly 478, cutter drive shafts 480, 482, cutter drive 484, roller drive shafts 486, roller drive 488, adjuster 490 and adjuster 492.

Margin carriage assembly 476 extends on one side of a sheet to be cut. Margin carriage assembly 476 includes block 494, a pair of opposite circular cutter blades 496 and rollers 498. Block 494 comprises a structure which rotationally supports blades 496. Block 494 further rotationally supports rollers 498. Block 494 is slidable along drive shafts 480, 482 and along drive shafts 486 relative to frame 224. Block 494 supports portions of adjuster 490.

Figure 17A:
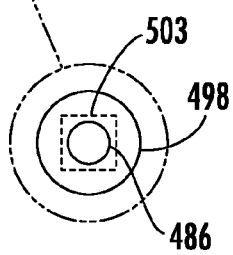
FIG. 17A is an enlarged fragmentary view of FIG. 17 schematically illustrated a keyed relationship between a shaft and roller.

Cutter blades 496 have outer circumferential edges that extend next to one another or overlap one another such a cut a sheet fed there between. Rollers 498 are rotationally supported by block 494 so as to move with block 494. Rollers 498 are configured to axially slide along shafts 486 while being keyed to shafts 486 such that rotation of shafts 486 rotationally drives rollers 498. The keyed relationship between one of rollers 489 and a corresponding one of shafts 486 is schematically illustrated by a schematic bock 503 shown in broken lines in FIG. 17A. Rollers 498 are configured to frictionally contact a sheet so as to move a sheet across blades 496 upon being rotationally driven. Although assembly 476 is illustrated as including four such rollers, in other embodiments, assembly 476 may have additional rollers 498.

Width carriage assembly 478 is similar to margin carriage assembly 476. Like assembly 476, assembly 478 includes block 504, a pair of opposite circular cutter blades 506 and rollers 508. Block 504 comprises a structure which rotationally supports blades 506. Block 504 further rotationally supports rollers 508. Block 504 is slidable along drive shafts 480, 482 and drive shafts 486 relative to frame 224. Block 504 supports portions of cutter drive 484 and roller drive 488.

Cutter blades 506 have outer circumferential edges that extend next to one another or overlap one another such a cut a sheet fed there between. Rollers 508 are rotationally supported by block 504 so as to move with block 504. Rollers 508 are configured to axially slide along shafts 486 while being keyed to shafts 486 such that rotation of shafts 486 rotationally drives rollers 508. Rollers 508 are configured to frictionally contact a sheet so as to move a sheet across blades 506 upon being rotationally driven. Although assembly 478 is illustrated as including four such rollers, in other embodiments, assembly 478 may have additional rollers 508.

Cutter drive shafts 480, 482 extend between assemblies 476, 478 and are keyed to blades 496, 506 such that rotation of shafts through 480, 482 rotationally drives blades 496, 506. At the same time, shafts 480, 420 may axially move through such blades. In the example illustrated, shafts 480 and 482 include an elongated axial groove 483 (shown in FIG. 12) that slidably receives a key or projection extending from each of blades 496, 506. In other embodiments, this relationship may be reversed.

Cutter drive 484 comprises device configured to rotationally drive shafts 480, 482 so as to rotationally drives blades 496, 506. Cutter drive 484 is carried by block 504 and includes motor 510 with encoder 512, pulleys 514, 516, 518, 520 and belts 522, 524. Motor 510 drives pulley 514 which is connected to cluster pulley 516 by belt 514. Belt 524 extends from pulley 516 and is engagement with pulleys 518, 520. Pulleys 518 and 520 are secured to axial ends of shafts 480 and 482, respectively. Although drive 484 is illustrated as using a belt and pulley arrangement, in other embodiments, drive 484 may comprise other mechanisms for rotationally driving shafts 480 and 482, such as a chain and sprocket arrangement, a gear train or other mechanisms.

Roller drive shafts 486 extend between assemblies 476, 478 and are keyed to rollers 498, 508 such that rotation of shafts 486 rotationally drives rollers 498, 508. At the same time, shafts 486 may axially move through such rollers. In the example illustrated, shafts 486 include an elongated axial groove 509 (shown in FIG. 12) that slidably receives a key or projection 511 (shown in FIG. 12) extending from each of rollers 498, 508. In other embodiments, this relationship may be reversed.

Roller drive 488 comprises a device configured to rotationally drive shafts 486 so as to rotationally drive blades rollers 498, 508. Roller drive 488 is carried by block 504 and includes motor 530 with encoder 532, a pulley 534 connected to each one of shafts 486 and belts 536. Motor 530 drives a pulleys (not shown) which is connected each of pulleys 534 by belt 536. Although drive 488 is illustrated as using a belt and pulley arrangement, in other embodiments, drive 488 may comprise other mechanisms for rotationally driving shafts 486, such as a chain and sprocket arrangement, a gear train or other mechanisms.

Adjuster 490 comprising mechanism configured to adjust the positioning of carriage assembly 478 relative to carriage assembly 476 so as to adjust the relative positioning of blades 506 relative to blades 496 to accommodate different margins or widths of media sheets. In the example illustrated, adjuster 490 includes motor 540, lead screw 542 and nut 544. Motor 540 rotationally drives lead screw 542 which is threaded through nut 544. Nut 544 is fixedly coupled to block 504. As a result, rotation motor 540 moves block 504 and blades 506 towards and away from blades 496. Likewise, rollers 508 are also moved towards and away from rollers 498. When motor 540 is not being driven, lead screw 542 rigidly interconnects blocks 494 and 504 to maintain the spacing between blades 496 and 506.

Adjuster 492 comprising mechanism to move blocks 496 and 504 in unison relative to frame 224 and the media path along which the sheet to be cut moves. Adjuster 492 includes motor 550, belt and pulley arrangement 552, lead screw 554 and nut 556. Motor 550 is supported by frame 224 and transmits torque to lead screw 554 through belt and pulley arrangement 552 to rotate lead screw 554. Lead screw 554 threadably passes through nut 556. Nut 556 is fixedly secured to block 494. As a result, rotation of lead screw 554 linearly translates block 494 along lead screw 556. Because block 494 is joined to block 504 by lead screw 542, such movement also results in block 504 and its blade 504 also being moved in unison with blade 496.

As shown by FIG. 5, receptacle 240 comprises a container configured to receive remnants from sheets that are taught by cutter assembly 238. Receptacle 240 is generally located below cutter assembly 238 such that the remnants fall into receptacle 38. As previously noted, receptacle 240 is contained within void 276 between modules 228, 230 and 232. Receptacle 240 is configured to be removed from accessory 220 for emptying.

As shown by FIGS. 4 and 9, sheet transport 242 comprises an arrangement of guide plates, drive rollers, either rollers, belts and the like configured to transport a cut sheet or distinct portions of a cut sheet from cutter assembly 238 to either tray 252 (shown in FIG. 3) or sorter 244. In the example illustrated, sheet transport 242 additionally includes a diverter 120 (schematically represented in FIG. 1) which pivots between a first position in which such cut sheets are directed to tray 252 and a second position in which shut sheets are directed further along sheet transport 242 to sorter 244. Actuation of the diverter 120 is achieved with a motor or other actuator 122 (schematically shown in FIG. 1) operably coupled to diverter 120 and driven in response to control signals from controller 48.

Sorter 244 comprises a device configured to receive cut sheets or portions of sheets from sheet transport 242 and to group or partition the sheets for retrieval. In the example illustrated, sorter 244 comprises belt 328 and paddles 330. Belt 328 comprises an endless belt supporting paddles 330. Panels 330 comprise panels, projections or other structures dimensioned and spaced so as to form intermediate document receiving cavities 332 which receive one or more sheets or portions of sheets to divide and separate different groups of sheets or portions of sheets.

In operation, one of paddles 330 is located at a substantially horizontal or slightly inclined orientation below an output of sheet transport 242. Sheet transport 242 transports and positions one or more sheets of a group onto the paddle 330. After each of the sheets are portions of sheets of a group have been deposited upon the paddle, paddle 328 is driven in response to control signals from controller 48 such that paddle 330 rotates to a vertical orientation and the next paddle 330 is in the horizontal or slightly inclined orientation ready to receive sheets of another group. As the paddles 330 are moved from left to right as seen in FIG. 4, groups of sheets, such as groups of photos, may be withdrawn and retrieved by an operator. If such groups of sheets or photos are not retrieved while paddle 330 is in a substantially vertical upwardly extending orientation, the one or more sheets are subsequently dumped or unloaded into overflow tray 254. In other embodiments, sorter 244 may have other configurations or may be omitted.

Overall, in operation, and inkjet printer 222 prints images or text upon sheets with our discharged into accessory 220 through input 250. Initially, each of modules 228-232 is empty. As a result, the first received sheet is immediately transported to cutter assembly 238. The second received sheet is transported to module 232 where it is staged or held in queue waiting for the first sheet to be cut and transported out of cutter assembly 238. The third received sheet is transported to and staged in module 230. The fourth received sheet is received and staged or held by module 228. Once the first sheet has been cut, each of the third and fourth sheets are transported to the next subsequent modules. At this time, 228 may receive another sheet from printer 222. Alternatively, in applications where inkjet printer 222 ejects printed upon sheets in batches, controller 48 may generate control signals communicating to inkjet printer 222 that accessory 220 is not yet ready to receive a batch of sheets.

Although accessory 220 is illustrated as including three modules configured to staged three sheets prior to cutting by cutter assembly 238, in other embodiments, accessory 220 may include a greater or fewer number of such modules and a greater or fewer number of such stages. As noted above, once the sheets are cut, they are transported and delivered to either tray 252 or to sorter 244. Although each of the various described components of accessory 222 is illustrated as being employed together to provide synergistic benefits, in other embodiments, such features may be employed independent of one another. For example, such features as modules 228, 230 and 232, cutter assembly 238 and sorter 244 may be used independent of one another. In addition, although accessory 20 and 220 are illustrated as being used with a printer 20 comprising an inkjet printer, in other embodiments, accessory 20 may be used with other printers or devices such as an electrostatic or electrophotographic printer.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

an accessory configured to be removably connected to an inkjet printer for receiving printed sheets from the printer, each of the printed sheets having a length between the leading edge and a trailing edge, the accessory comprising:

a first sheet sandwiching transport comprising first and second belt assemblies, each belt assembly comprising:

a first drive roller having a first rotational axis;

a first idler roller having a second rotational axis spaced from the first rotational axis greater than the length of the sheets; and at least one belt about the first drive roller and the first idler roller; and a cutter assembly comprising:

a first blade movable to cut the leading edge of the sheet; and a second blade movable to cut the trailing edge of the sheet.

2. The apparatus of claim 1 further comprising a second sheet sandwiching transport configured to receive a sheet from the first sheet sandwiching transport, the second sheet sandwiching transport comprising third and fourth opposite belt assemblies configured to sandwich the sheet therebetween.

3. The apparatus of claim 1, wherein the first blade is movable towards and away from the second blade.

4. The apparatus of claim 1, wherein the first blade is movable towards and away from the second blade and wherein the first sheet sandwiching transport is configured to pivot in response to movement of the first blade towards and away from the second blade.

5. The apparatus of claim 1, wherein the cutter assembly further comprises:

a third blade movable to cut a first side of the sheet; and a fourth blade movable to cut a second opposite side of the sheet.

6. The apparatus of claim 5, wherein the third blade and the fourth blade are rotationally driven.

7. The apparatus of claim 5, wherein the third blade is movable towards and away from the fourth blade.

8. The apparatus of claim 7, wherein the third blade and the fourth blade are movable in unison relative to the sheet to be cut.

9. The apparatus of claim 1, wherein the at least one belt of each of the first belt assembly and the second belt assembly are driven at a substantially same speed.

10. The apparatus of claim 1 further comprising a sorter configured to partition groups of cut portions of sheets.

11. The apparatus of claim 1 further comprising:

a frame;

a sheet interaction device configured to perform at least one of cutting, sorting and collating on sheets; and a plurality of sheet sandwiching transport modules, each sheet sandwiching transport module being removably received by the frame as a single unit and configured to stage a sheet as sheets are sequentially move to the sheet interaction device, one of the plurality of sheet sandwiching transport modules comprising the first sheet sandwiching transport.

12. The apparatus of claim 11, wherein the frame comprises:

an access opening; and guiding structures which guide movement of one of the plurality of sheet sandwiching transport modules as a single unit through the access opening into the frame.

13. The apparatus of claim 1 wherein the first sheet sandwiching transport is configured to pivot in response to movement of the second blade away from the first blade.

14. An apparatus comprising:

an accessory configured to be removably connected to an inkjet printer for receiving printed sheets from the printer, each of the printed sheets having a length between a leading edge and a trailing edge, the accessory comprising:

a first sheet sandwiching transport comprising first and second belt assemblies, each belt assembly comprising:

a first drive roller having a first rotational axis;

a first idler roller having a second rotational axis spaced from the first rotational axis greater than the length of the sheets; and at least one belt about the first drive roller and the first idler roller, wherein the first sheet sandwiching transport receives and stages individual sheets, one at a time, wherein the first sheet sandwiching transport is situated to directly contact opposite faces of an individual printed upon sheet received from the printer and wherein the first rotational axis is spaced from the second rotational axis by greater than 11 inches.

15. An apparatus comprising:

an accessory configured to be removably connected to an inkjet printer for receiving printed sheets from the printer, each of the printed sheets having a length between the leading edge and a trailing edge, the accessory comprising:

a first sheet sandwiching transport comprising first and second belt assemblies, each belt assembly comprising:

a first drive roller having a first rotational axis;

a first idler roller having a second rotational axis spaced from the first rotational axis greater than the length of the sheets; and at least one belt about the first drive roller and the first idler roller;

a second sheet sandwiching transport;

a third sheet sandwiching transport;

a cutter assembly configured to cut sheets received from the first sheet sandwiching transport; and a receptacle configured to receive portions of sheets cut by the cutter assembly, wherein the first sheet sandwiching transport extends on a first side of the receptacle, wherein the second sheet sandwiching transport extends on a second opposite side of the receptacle and wherein the third sheet sandwiching transport extends on a third side of the receptacle.

16. An apparatus comprising:

an accessory configured to be removably connected to an inkjet printer for receiving printed sheets from the printer, each of the printed sheets having a length between the leading edge and a trailing edge, the accessory comprising:

a first sheet sandwiching transport comprising first and second belt assemblies, each belt assembly comprising:

a first drive roller having a first rotational axis;

a first idler roller having a second rotational axis spaced from the first rotational axis greater than the length of the sheets; and at least one belt about the first drive roller and the first idler roller, wherein the inkjet printer prints on a first face of a sheet and wherein the accessory further comprises a printing device configured to print on a second opposite face of the sheet while the sheet is sandwiched between the first and second belt assemblies of the first sheet sandwiching transport.

17. An apparatus comprising:

an accessory configured to be removably connected to an inkjet printer for receiving printed sheets from the printer, each of the printed sheets having a length between the leading edge and a trailing edge, the accessory comprising:

a first sheet sandwiching transport comprising first and second belt assemblies, each belt assembly comprising:

a first drive roller having a first rotational axis;

a first idler roller having a second rotational axis spaced from the first rotational axis greater than the length of the sheets; and at least one belt about the first drive roller and the first idler roller;

a second sheet sandwiching transport configured to transport sheets to the first sheet sandwiching transport;

a third sheet sandwiching transport configured to transport sheets to the second sheet sandwiching transport;

at least one sensor configured to sense a sheet in at least one of the first sheet sandwiching transport, the second sheet sandwiching transport and the third sheet sandwiching transport; and a controller configured to generate control signals based upon signals from the at least one sensor, wherein the third sheet sandwiching transport stages a sheet until the second sheet sandwiching transport is empty and wherein the second sheet sandwiching transport stages a sheet until the first sheet sandwiching transport is empty in response to the control signals.

18. The apparatus of claim 17 power the control signals generated by the controller are partially based upon signals received from the inkjet printer.

19. The apparatus of claim 17, wherein the least one sensor includes:

a first sensor; and a second sensor spaced from the first sensor by a distance, wherein the controller is configured to compare signals from the first sensor and a second sensor to identify sheet slippage and wherein the controller is configured to adjust operational parameters of at least one of the first sheet sandwiching transport, the second sheet sandwiching transport and at the third sheet sandwiching transport to account for sheet slippage.

20. An apparatus comprising:

a cutter assembly comprising:

a first blade movable to cut the leading edge of the sheet;

a second blade movable to cut the trailing edge of the sheet;

a third blade movable to cut a first side of the sheet; and a fourth blade movable to cut a second opposite side of the sheet, wherein the third blade is movable towards and away from the fourth blade;

a driveshaft; and a roller coupled to the third blade so as to move with the third blade towards and away from the fourth blade, wherein the roller is keyed to the driveshaft so as to be rotationally driven by the driveshaft and axially slidable with respect to the driveshaft.

21. The apparatus of claim 20 further comprising:

an accessory configured to be removably connected to an inkjet printer for receiving printed sheets from the printer, each of the printed sheets having a length between the leading edge and a trailing edge, the accessory comprising:

a first sheet sandwiching transport comprising first and second belt assemblies, each belt assembly comprising:

a first drive roller having a first rotational axis;

a first idler roller having a second rotational axis spaced from the first rotational axis greater than the length of the sheets; and at least one belt about the first drive roller and the first idler roller.

* * * * *